US006980936B2

(12) United States Patent
Xu et al.

(10) Patent No.: US 6,980,936 B2
(45) **Date of Patent: *Dec. 27, 2005**

(54) KNITWEAR MODELING

(75) Inventors: Ying-Qing Xu, Beijing (CN); Baining Guo, Bellevue, WA (US); Hua Zhong, Redmond, WA (US); Heung-Yeung Shum, Beijing (CN)

(73) Assignee: Microsoft Corp., Redmond, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/995,986

(22) Filed: Nov. 20, 2004

(65) Prior Publication Data

US 2005/0115285 A1 Jun. 2, 2005

Related U.S. Application Data

(63) Continuation of application No. 09/620,533, filed on Jul. 23, 2000, now Pat. No. 6,871,166.

(51) Int. Cl.[7] ..... G06F 17/50
(52) U.S. Cl. ..... 703/1; 703/6
(58) Field of Search ..... 703/1, 2, 6

(56) References Cited

OTHER PUBLICATIONS

Groller et al., Modeling textiles as three dimensional textures, Eurographics Rendering Workshop, Jun. 1998, pp. 205-214.*
Kajiya et al., Rendering fur with three dimensional textures, Computer Graphics (Proceedings of SIGGRAPH 88), 23 (3)-271-280, Jul. 1989.*
Watanabe et al., A trigonal prism-based method for hair image generation, IEEE Computer Graphics and Applications, 12(1): 47-53, Jan. 1992.*
Yasuda et al., A shading model for cloth objects, IEEE Computer Graphics and Applications, 12(6): 15-24, Nov. 1992.*
Harmony Guide to Knitting, Debra Mountford, editor, pp. 11-20 (1992).*
Westin et al., Predicting reflectance functions from complex surfaces, Computer Graphics, Proceedings of SIGGRAPH 92, 26(2):255-264, Jul. 1992.*
Aniyo et al., A simple method for extracting the natural beauty of hair, Computer Graphics, Proceedings of SIGGRAPH 92, 26(2):111-120, Jul. 1992.*
Goldman, Fake fur rendering, Proceedings of SIGGRAPH 97, pp. 127-134, Aug. 1997.*
Thalman et al., Virtual clothes, hair and skin for beautiful top models, Computer Graphics International 1996.*
Dana et al., Reflectance and texture of real-world surfaces, ACM Transactions on Graphics, 18(1):1-34, Jan. 1999.*
Neyrel, Modeling, animating and rendering complex scenes using volumetric textures, IEEE Transactions on Visualization and Computer Graphics, 4(1):55-70, Jan.-Mar. 1998.*
Groller et al., Modeling and Visualization of Knitwear, IEEE Transactions on Visualization and Computer Graphics, 1(4): 302-310, Dec. 1995.*
Chen et al., Realistic rendering and animation of knitwear, IEEE Transactions on Visualization and Computer Graphics, vol. 9, No. 1, Jan.-Mar. 2003, pp. 43-55.*

* cited by examiner

*Primary Examiner*—Russell Frejd
(74) *Attorney, Agent, or Firm*—Lyon & Harr, LLP; Katrina A. Lyon

(57) ABSTRACT

Knitwear modeling is disclosed. A macrostructure correponding to a three-dimensional object is generated, based on a stitch pattern and optionally a color pattern. Yarn microstructure is generated and applied to the macrostructure to yield a knitwear model. The stitch positions of the macrostructure can be perturbed to achieve stitch position irregularities. The fluffiness of the yarn microstructure can be controlled. In an alternative embodiment, a two-dimensional knitwear texture is generated, which can then be mapped to a three-dimensional object to yield a knitwear model.

32 Claims, 20 Drawing Sheets

APPLY MICROSTRUCTURE TO MACROSTRUCTURE TO YIELD RENDERED KNITWEAR MODEL
106
RENDERED KNITWEAR MODEL
118
100
YIELDS
122
102
120
GENERATED YARN MICROSTRUCTURE
KNITWEAR SKELETON (MACROSTRUCTURE)
108
YIELDS
116
110
114
112
STITCH PATTERN
OBJECT SURFACES
COLOR PATTERN (OPTIONAL)
104
CREATE MACROSTRUCTURE OF MODEL

CREATE MICROSTRUCTURE

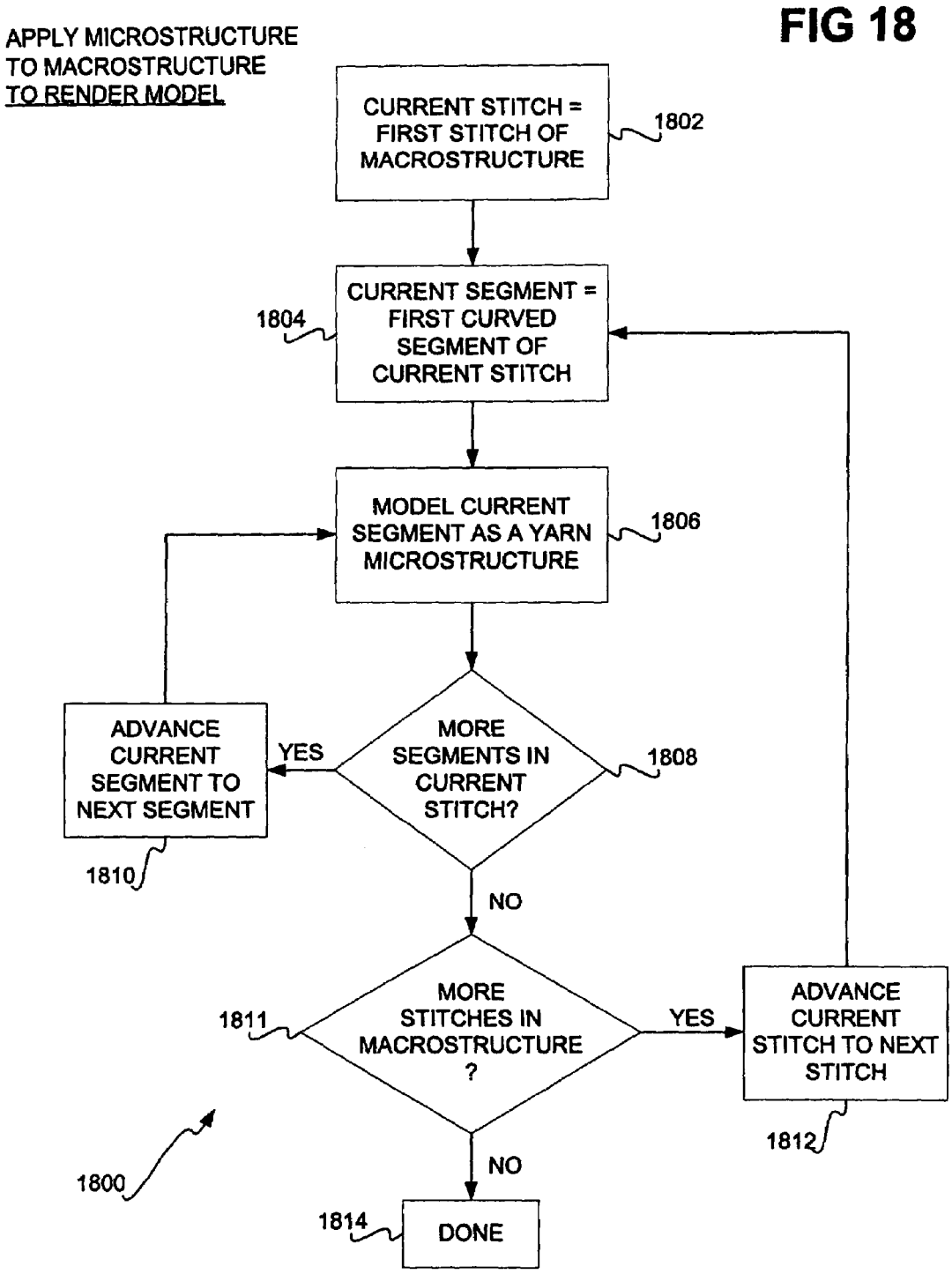
FIG 18
APPLY MICROSTRUCTURE TO MACROSTRUCTURE TO RENDER MODEL
CURRENT STITCH = FIRST STITCH OF MACROSTRUCTURE
1802
CURRENT SEGMENT = FIRST CURVED SEGMENT OF CURRENT STITCH
1804
MODEL CURRENT SEGMENT AS A YARN MICROSTRUCTURE
1806
MORE SEGMENTS IN CURRENT STITCH?
1808
YES
ADVANCE CURRENT SEGMENT TO NEXT SEGMENT
1810
NO
MORE STITCHES IN MACROSTRUCTURE ?
1811
YES
ADVANCE CURRENT STITCH TO NEXT STITCH
1812
NO
DONE
1814
1800

KNITWEAR MODELING

CROSS-REFERENCE TO RELATED APPLICATIONS

This application is a continuation of a prior application entitled "KNIT WEAR MODELING" which was assigned Ser. No. 09/620,533 and filed Jul. 23, 2000, now U.S. Pat. No. 6,871,166.

FIELD OF THE INVENTION

This invention relates generally to three-dimensional (3D) modeling and two-dimensional textures for 3D modeling, and more specifically to knitwear modeling.

BACKGROUND OF THE INVENTION

For applications as diverse as animation, electronic commerce ("e-commerce"), design and prototyping work, as well as other types of applications, computer graphics modeling is important. For example, within an e-commerce Internet web site, a user may be able to see a computer-rendered model wearing the clothes that he or she is potentially interested in buying. The use of computer modeling in such an application allows the user to ultimately make a more informed decision regarding his or her purchase, lessening the chance of a product being returned.

A type of clothing that consumers can commonly purchase in retail and online stores is knitwear. The real-world process for constructing knitwear clothes includes spinning raw fibers into yarn, which is knitted into fabric based on a stitch pattern, and optionally a color pattern. The knitted fabric is then sewn into the desired clothing, such as a shirt, sweater, or other type of clothing.

Within the prior art, however, there is no provision for computer modeling of knitwear. This is a disadvantage in applications where knitwear modeling is needed, such as in e-commerce. For this and other reasons, there is a need for the present invention.

SUMMARY OF THE INVENTION

The present invention relates to knitwear modeling. A knitwear skeleton, or macrostructure, is generated for a desired three-dimensional object. The three-dimensional object can be, for example, a human model wearing knitwear clothing, or another type of three-dimensional object. The macrostructure is based on a stitch pattern and optionally a color pattern. Yam microstructure is generated and applied to the knitwear skeleton to yield a knitwear model. In an alternative embodiment of the invention, a two-dimensional knitwear texture is generated. The two-dimensional knitwear texture can be applied, or mapped, to a three-dimensional object to yield a knitwear model. The invention includes methods and machine-readable media of varying scope. Other aspects and embodiments of the invention, beyond those described here, will become apparent by reading the detailed description and by reference to the drawings.

BRIEF DESCRIPTION OF THE DRAWINGS

FIG. 18 is a flowchart of a method to apply a yarn microstructure to a knitwear skeleton to render a knitwear model, according to an embodiment of the invention;

DETAILED DESCRIPTION OF THE INVENTION

In the following detailed description of exemplary embodiments of the invention, reference is made to the accompanying drawings that form a part hereof, and in which is shown by way of illustration specific exemplary embodiments in which the invention may be practiced. These embodiments are described in sufficient detail to enable those skilled in the art to practice the invention. Other embodiments may be utilized, and logical, mechanical, electrical, and other changes may be made without departing from the spirit or scope of the present invention. The following detailed description is, therefore, not to be taken in a limiting sense, and the scope of the present invention is defined only by the appended claims.

Overview of the Invention

Figure 1:
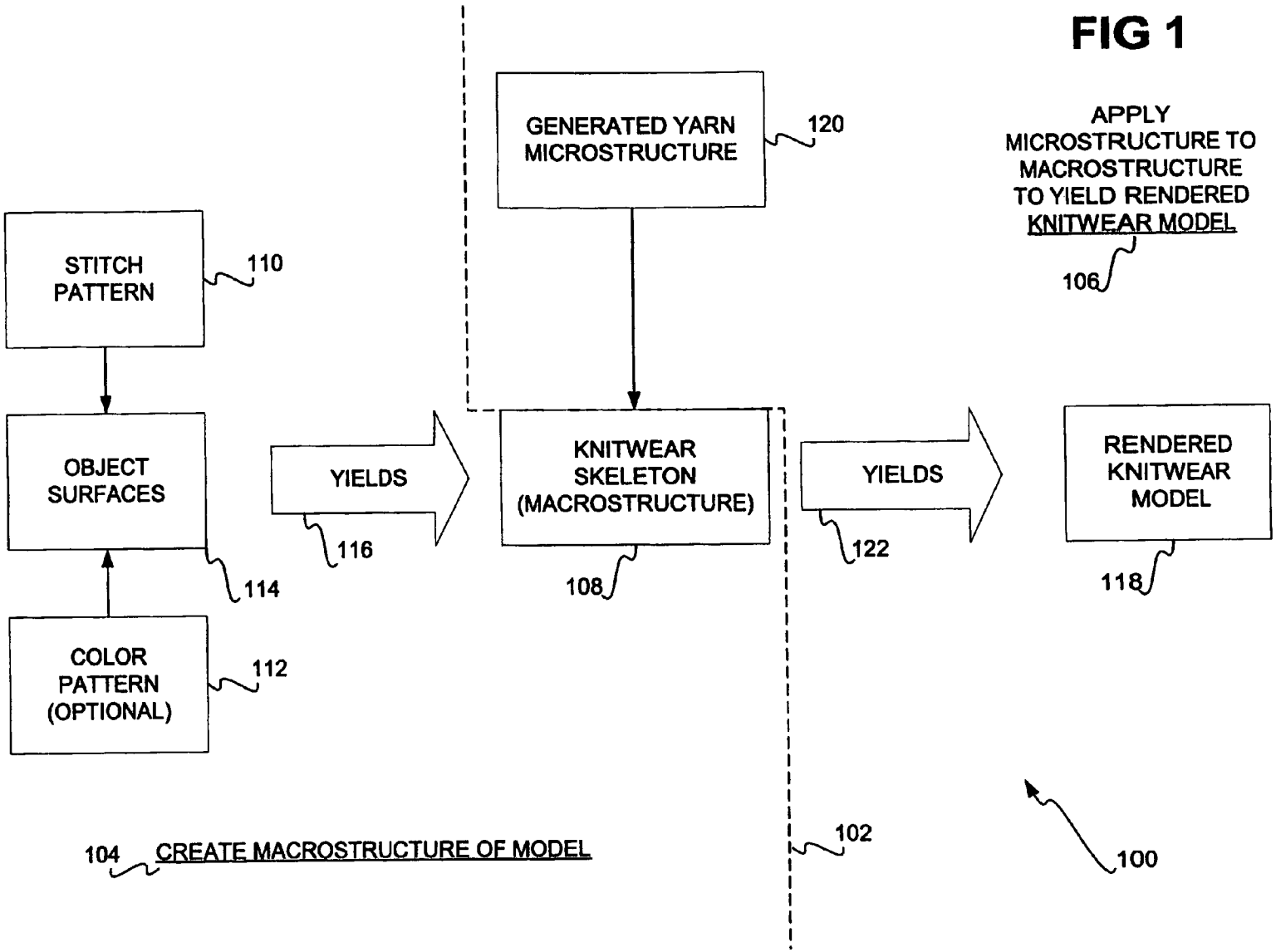
FIG. 1 is a diagram outlining the basic process that embodiments of the invention perform to render a knitwear model.

The diagram 100 of FIG. 1 illustrates the overall process that preferred embodiments of the invention perform to render a knitwear model. The process includes two parts.

First, as indicated by reference number 104, a macrostructure 108, or knitwear skeleton, is created. Second, as indicated by reference number 106, a generated yarn microstructure 120 is applied to the macrostructure 108 to yield the rendered knitwear model 118. A dotted line 102 separates the parts of the diagram 100 that are performed in the first part of the process from the parts of the diagram 100 that are performed in the second part. Each of these parts is described in turn.

Figure 2:
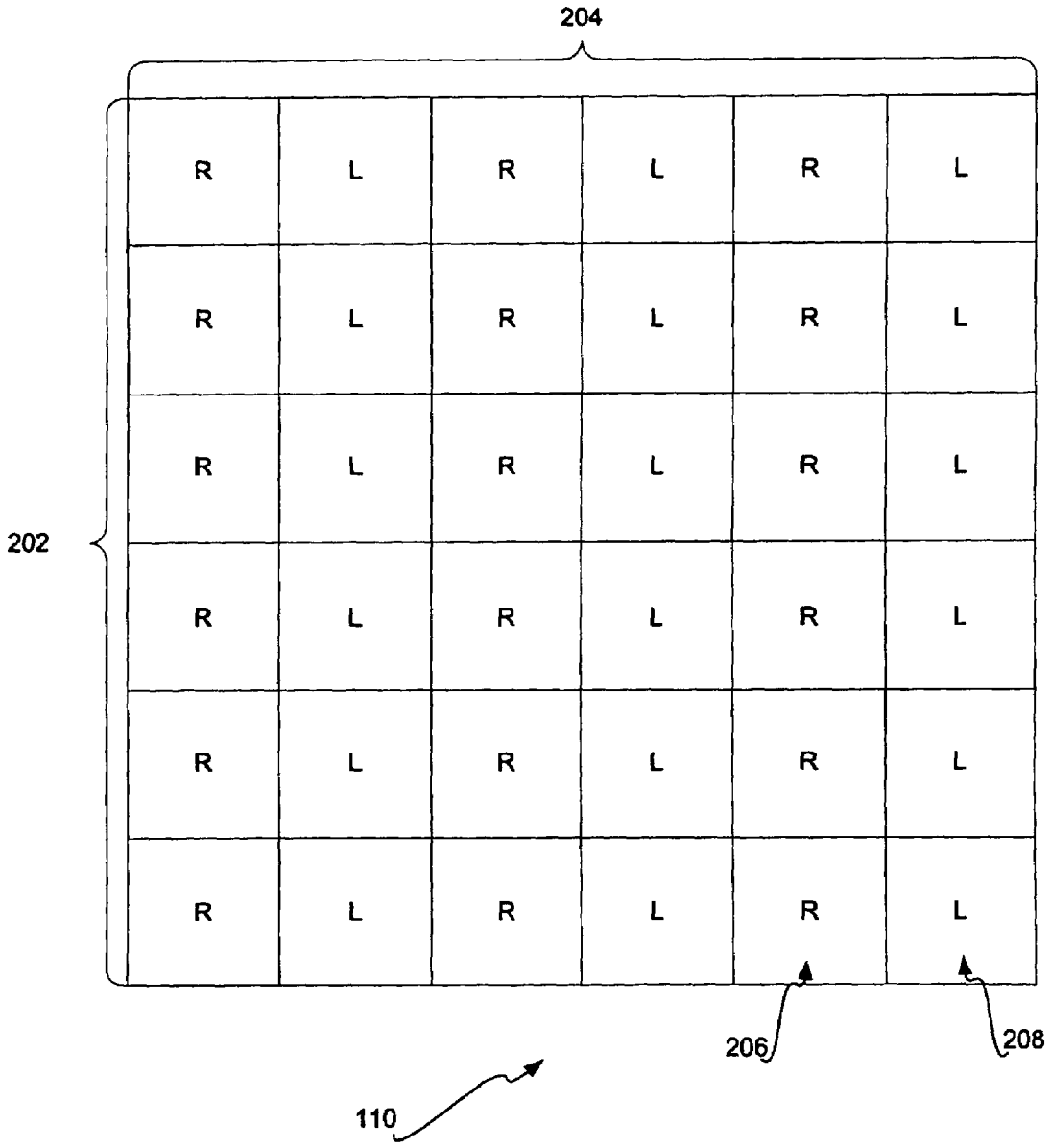
FIG. 2 is a diagram of an example stitch pattern.

To create the macrostructure 108, embodiments of the invention apply a stitch pattern 110, and optionally a color pattern 112, to the object surfaces 114 of a three-dimensional object. The three-dimensional object can be a human model wearing knitwear clothing, or another type of three-dimensional object. A diagram of an example stitch pattern 110 is shown in FIG. 2. The example stitch pattern 110 of FIG. 2 is a grid of stitches organized into rows 202 and columns 204. Each stitch, such as the example stitches 206 and 208, is indicated as a plain, R-loop stitch by the letter "R," or as a reverse, L-loop stitch by the letter "L."

Figure 3:
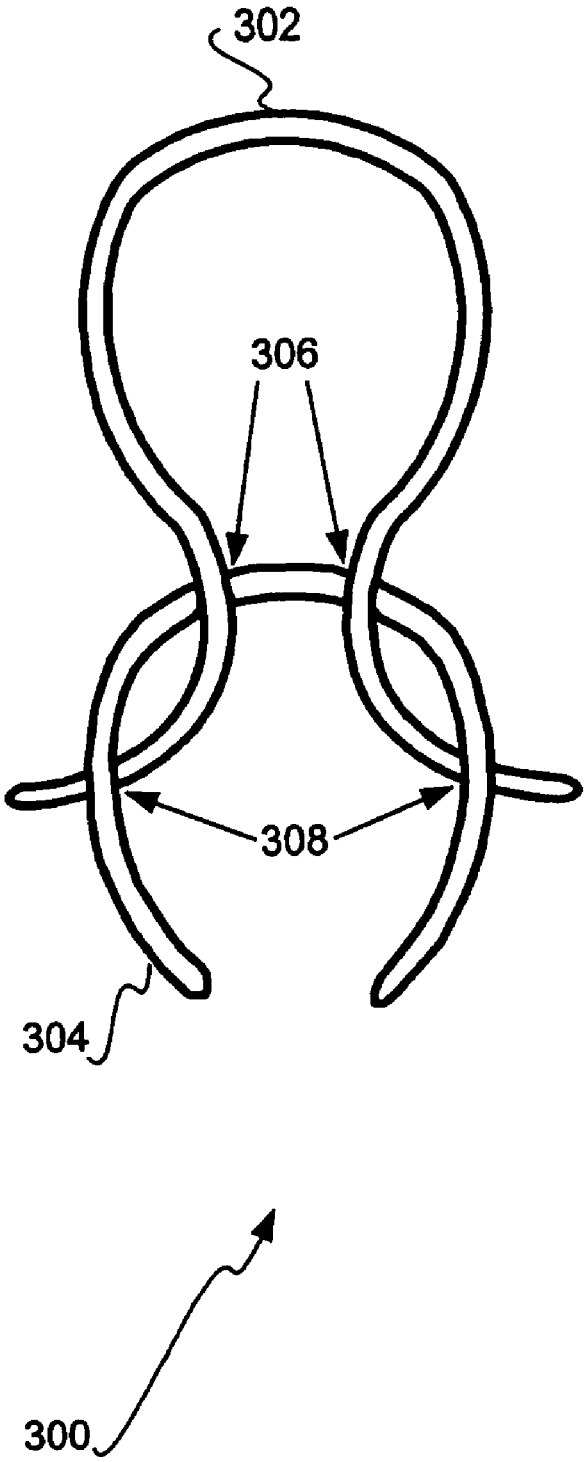
FIG. 3 is a diagram of a basic plain stitch.

The R-loop and the L-loop stitches are the two basic stitches used in knitting, and provide the basis for most knitted fabrics. The two stitches are the reverse of one another. FIG. 3 shows an R-loop stitch 300 made up of a first stitch loop 302 looped over and then under a second stitch loop 304. The arrows identified by the reference number 306 indicate the initial looping over of the first stitch loop 302 relative to the second stitch loop 304. The arrows identified by the reference number 308 indicate the subsequent looping under of the first stitch loop 302 relative to the second stitch loop 304.

Figure 4:
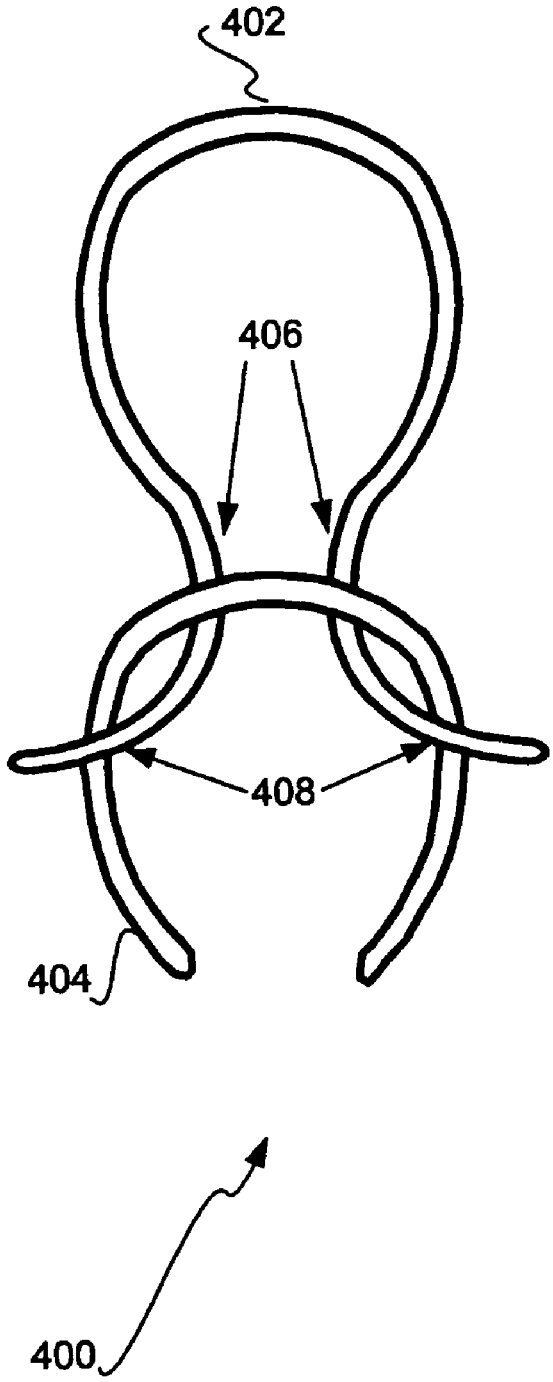
FIG. 4 is a diagram of a basic reverse stitch.

By comparison, FIG. 4 shows an L-loop stitch 400 made up of a first stitch loop 402 looped under and then over a second stitch loop 404. The arrows identified by the reference number 406 indicate the initial looping under of the first stitch loop 402 relative to the second stitch loop 404. The arrows identified by the reference number 408 indicate the subsequent looping over of the first stitch loop 402 relative to the second stitch loop 404. Whereas an R-loop stitch first loops over and then under, an L-loop stitch first loops under and then over.

Figure 5:
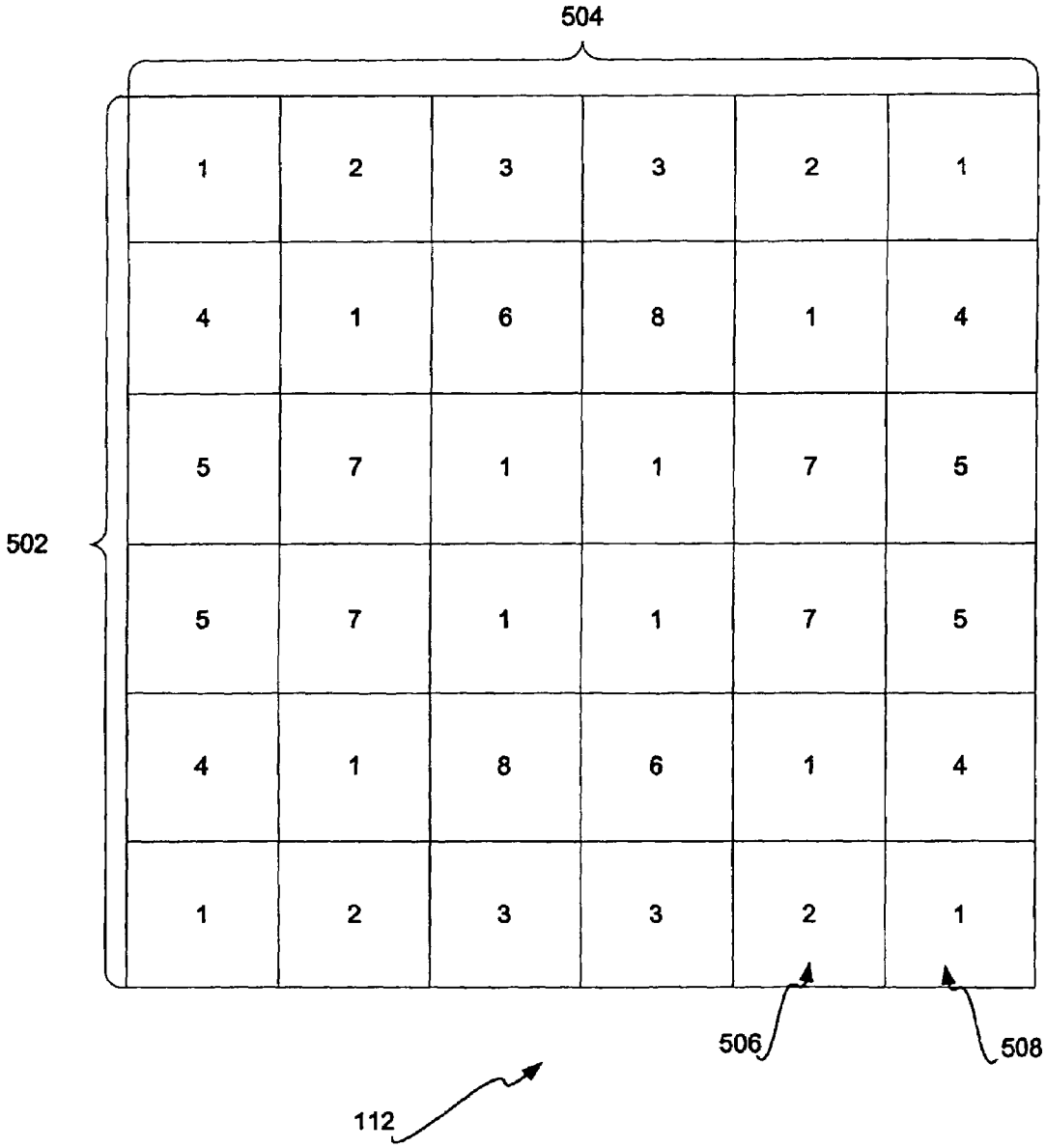
FIG. 5 is a diagram of an example color pattern.

Referring back to FIG. 1, embodiments of the invention can optionally apply a color pattern 112 to the object surfaces 114 in addition to applying the stitch pattern 110 to the object surfaces 114. The color pattern 112 specifies the color of each stitch of the stitch pattern 110 on a stitch-by-stitch basis. Where a color pattern 112 is not used, the stitch pattern 110 can be entirely of the same color, for instance. FIG. 5 shows a diagram of an example color pattern 112. The example color pattern 112 is a grid of stitch colors organized into rows 502 and columns 504. Each stitch color corresponds to and indicates the color of a stitch of the stitch pattern 110 of FIG. 2. For example, the example stitch colors 506 and 508 of FIG. 5 indicate the colors of the example stitches 206 and 208, respectively, of FIG. 2. Each stitch color is identified by a color number corresponding to a predetermined color. The example color pattern 112 of FIG. 5 specifically utilizes eight different colors, identified by the whole numbers between and including one and eight.

Referring back to FIG. 1, application of the stitch pattern 110 and optionally the color pattern 112 to the object surfaces 114 of a three dimensional object yields a knitwear skeleton 108, as indicated by the arrow 116. The knitwear skeleton 108 is another term for the macrostructure, and the two terms are used interchangeably in this application. The knitwear skeleton 108 is a network of interlocking curves constructed according to the object surfaces 114 as the stitch pattern 110 and optionally the color pattern 112 have been applied to these surfaces. A subsequent section of the detailed description specifies in detail how one embodiment of the invention applies the stitch pattern 110 and optionally the color pattern 112 to the object surfaces 114 of a three-dimensional object to yield the knitwear skeleton 108.

The first part of the process identified by the reference number 104 in FIG. 1 thus results in a knitwear skeleton 108. The skeleton 108 has an overall three-dimensional knitted structure. However, the knitwear skeleton 108 differs from the ultimately rendered knitwear model in that, unlike the knitwear model, the skeleton 108 does not have yarn fiber structure. The three-dimensional knitted structure of the knitwear skeleton 108 has stitches, and optionally color, but is more akin to a wire model made up of wire-like stitches than a knitwear model made up of yarn fiber stitches. Therefore, the second part of the process performed by preferred embodiments of the invention, identified by the reference number 106, gives the knitwear skeleton 108 a knitted fabric look at the yarn fiber level to yield a rendered knitwear model 118.

In particular, a generated yarn microstructure 120 is modeled along the stitch curves of the knitwear skeleton 108 to yield the rendered knitwear model 118, as indicated by the arrow 122. The yarn microstructure 120 specifies the modeling of yarn fibers. Applying the microstructure 120 to the skeleton 108 transforms the skeleton 108 to a rendered knitwear model 118. Whereas the knitwear skeleton 108 has been referred to as more akin to a wire model having wire-like stitches, applying the yarn microstructure 120 to the skeleton 108 yields a rendered knitwear model 118 that has stitches approximating yarn fibers. A subsequent section of the detailed description specifies in detail how one embodiment of the invention generates the yarn microstructure 120 and applies it to the knitwear skeleton 108 to yield the rendered knitwear model 118.

Figure 6:
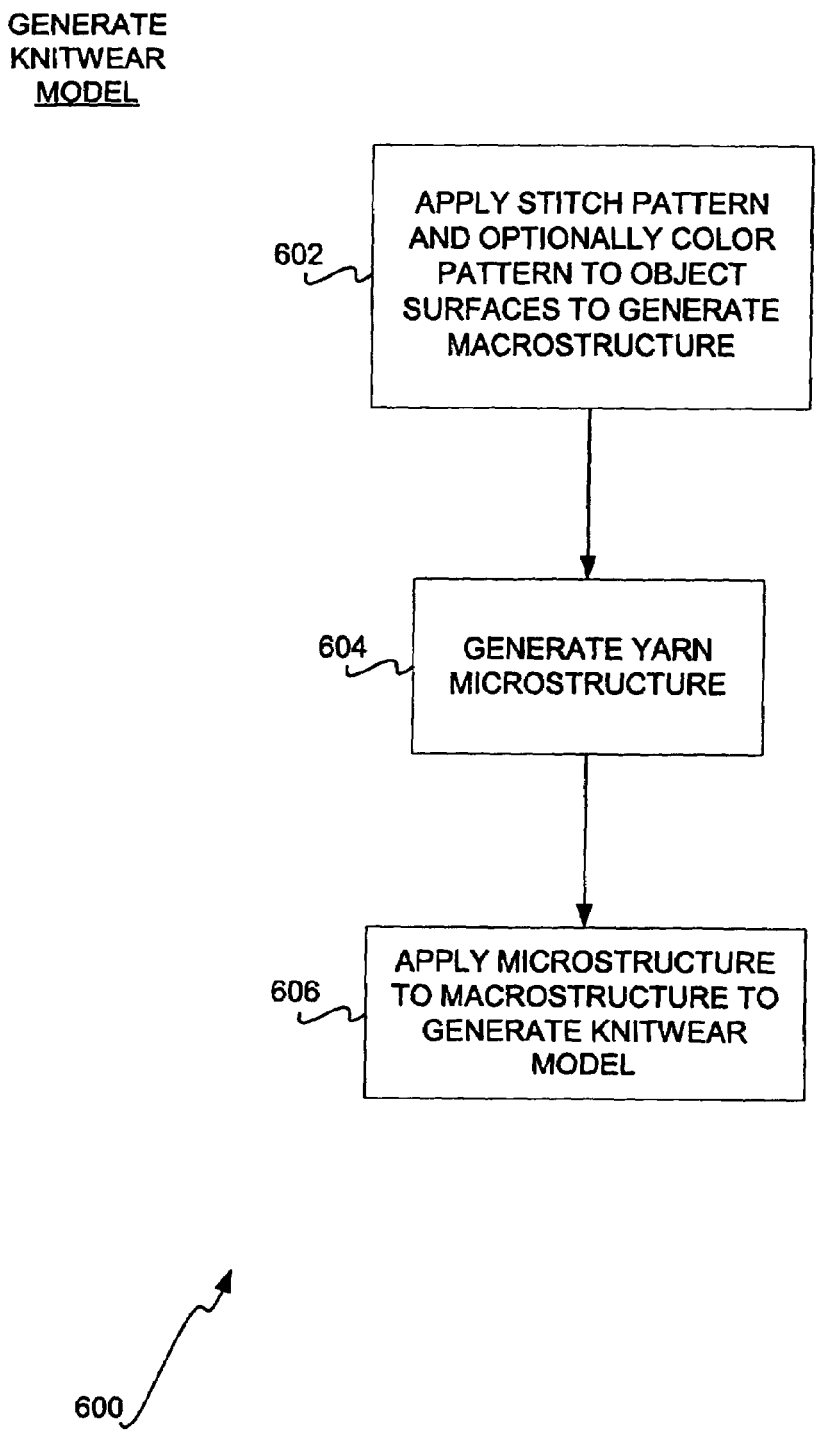
FIG. 6 is a flowchart of a method summarizing the basic process of FIG. 1 that embodiments of the invention follow to render a knitwear model.

FIG. 6 is a flowchart illustrating a method 600 that summarizes the process performed by preferred embodiments of the invention to render a knitwear model. In 602, the method applies a stitch pattern, and optionally a color pattern, to the object surfaces of a three-dimensional object to generate a macrostructure, or knitwear skeleton. In 604, yarn microstructure is generated, which is then applied to the macrostructure in 606 to yield the knitwear model. The subsequent sections of the detailed description describe in more detail each part of the method 600, as well as alternative embodiments of the invention, and an example computerized device in conjunction with which with the invention can be used.

Generating the Macrostructure, or Knitwear Skeleton

Figure 7:
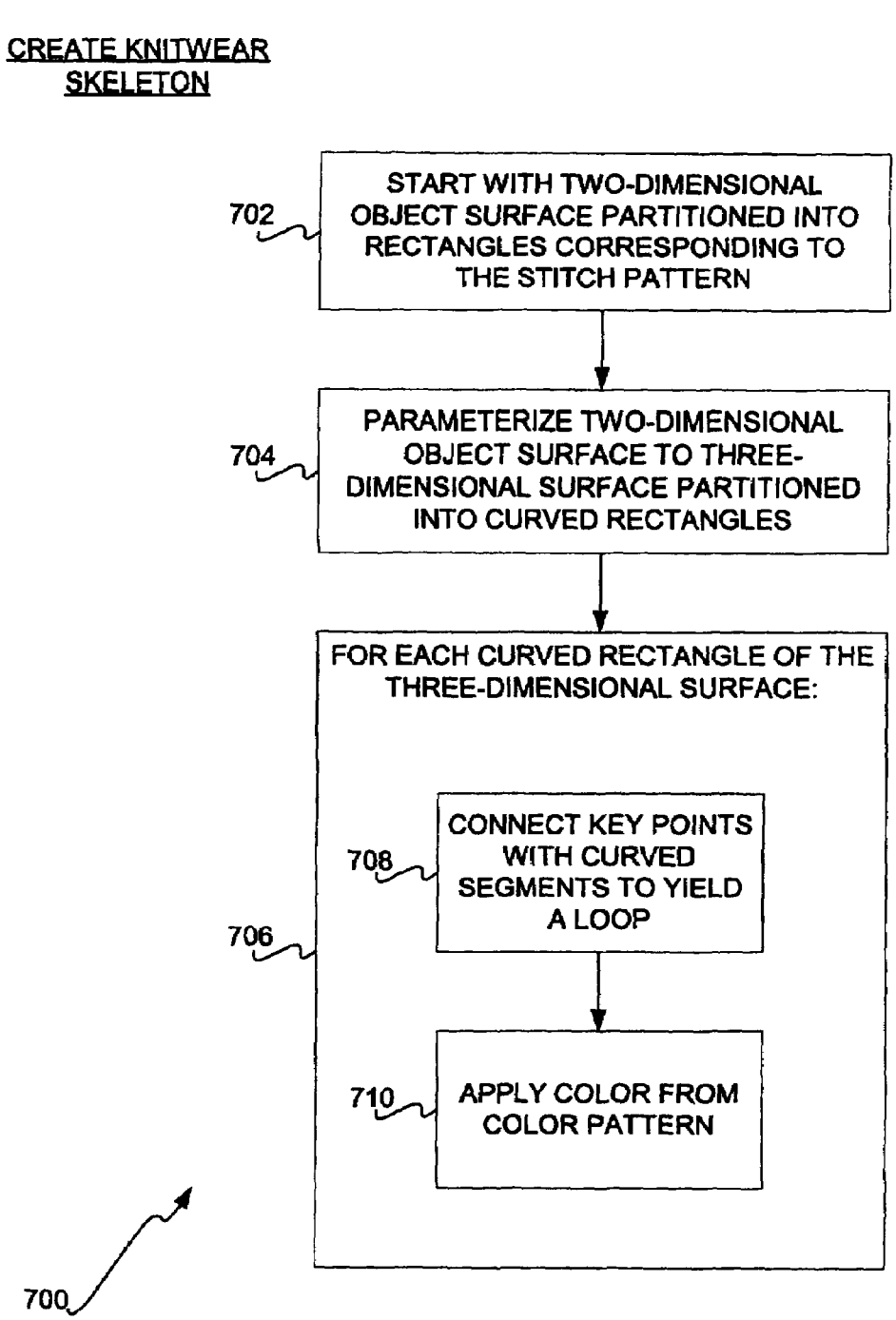
FIG. 7 is a flowchart of a method to generate a knitwear skeleton, or macrostructure, according to an embodiment of the invention.

FIG. 7 is a flowchart of a method 700 that one embodiment of the invention performs to generate the macrostructure. The method 700 can be utilized to yield the knitwear skeleton 108 of FIG. 1, for example. In 702, the method starts with a two-dimensional object surface corresponding to a stitch pattern. The surface is partitioned into rectangles that correspond to the stitches of the stitch pattern. The stitch pattern, for example, can be the stitch pattern 110 of FIG. 1. The rectangles are also referred to as tiles.

Figure 8:
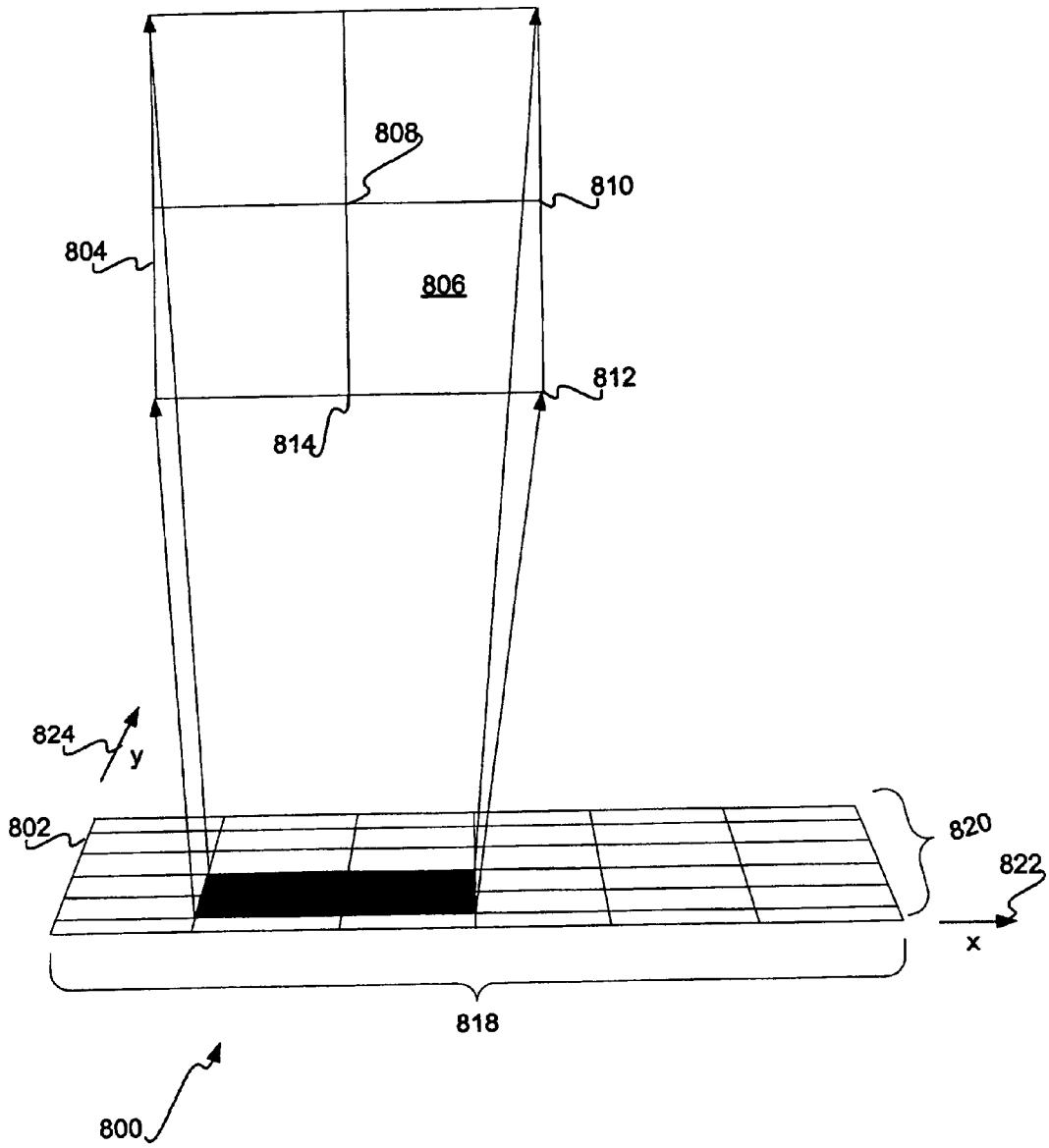
FIG. 8 is a diagram of an example two-dimensional object surface.

An example of a two-dimensional object surface that has been partitioned into rectangles is shown in the diagram 800 of FIG. 8. The two-dimensional object surface 802 is itself a rectangle, and corresponds to a surface patch in the (u, v) domain defined over the x-axis 822 and the y-axis 824. The surface 802 is partitioned into a grid of tiles organized into columns 818 and rows 820. Each tile can be identified by its four corner points. For example, in the expanded section 804 of the surface 802, the tile 806 is identified by the points 808, 810, 812, and 814, which are referred to as the points $n_0$, $n_1$, $n_2$, and $n_3$, respectively. Each point can be defined by a (u, v) pair corresponding to its position along the x-axis 822 and along the y-axis 824, respectively.

Referring back to FIG. 7, in 704, the method parameterizes the two-dimensional object surface to yield a three-dimensional surface. More specifically, the two-dimensional object surface corresponding to a stitch pattern is parameterized according to the object surfaces of a desired three-dimensional object. For example, the three-dimensional object can be a human figure wearing knitwear clothes. The resulting three-dimensional surface is partitioned into curved rectangles that correspond to the rectangles of the two-dimensional object surface. The curved rectangles can also be referred to as curved tiles.

Figure 9:
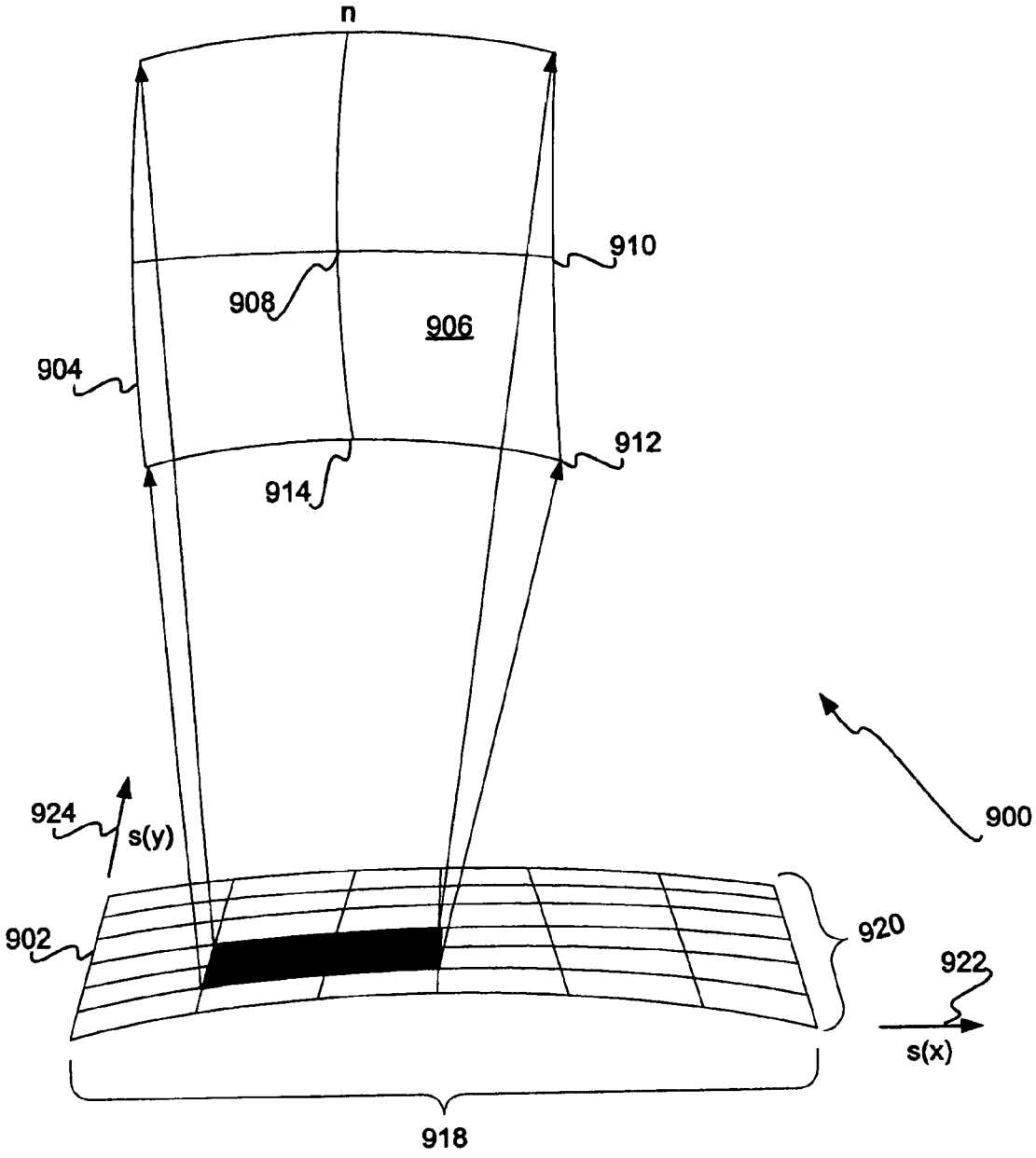
FIG. 9 is a diagram of an example three-dimensional surface resulting from the parameterization of the two-dimensional object surface of FIG. 8.

FIG. 9 shows a diagram 900 of a parametric, three-dimensional object surface 902 that results from the parameterization of the two-dimensional object surface 802 of FIG. 8. The three-dimensional object surface 902 is itself a curved rectangle, and corresponds to a surface patch in the s(u, v) parameter space defined over the s(x) axis 922 and the s(y) axis 924. The function s(•) is a parameterization function. The three-dimensional surface 902 is partitioned into a grid of curved tiles organized into columns 918 and rows 920.

Each curved tile within the three-dimensional surface 902 can be identified by its four corner points. For example, in the expanded section 904 of the three-dimensional surface 902, the tile 906 is identified by the points 908, 910, 912, and 914, which are referred to as the parameterized points $s(n_0)$, $s(n_1)$, $s(n_2)$, and $s(n_3)$, respectively. Each parameterized point can be defined by an s(u, v)=s(u), s(v) pair corresponding to its position along the parameterized x axis 922 and the parameterized y-axis 924, respectively. The expanded section 904 of the three-dimensional surface 902 corresponds to the parameterization of the expanded section 804 of the two-dimensional surface 802 of FIG. 8. Where the latter section has a rectangle identified by the points $n_0$, $n_1$, $n_2$, and $n_3$, the former section has a corresponding curved rectangle identified by the corresponding parameterized points $s(n_0)$, $s(n_1)$, $s(n_2)$, and $s(n_3)$.

Referring back to FIG. 7, the result of 704 is a three-dimensional surface that is the parameterization of a two-dimensional object surface corresponding to a stitch pattern along the object surfaces of a three-dimensional object. The method parameterizes the two-dimensional object surface of the stitch pattern along the surfaces of the three-dimensional object to yield the three-dimensional surface. This three-dimensional surface ultimately becomes the macrostructure, or knitwear skeleton, by performing 706.

In 706, for each curved rectangle of the three-dimensional surface, 708 and 710 are performed. In 708, the method connects key points with curved segments to yield a stitch loop. There are two stitch loops in each stitch, and a stitch is located in each curved rectangle. Each three-dimensional stitch loop of a curved rectangle is the parameterization of the two-dimensional stitch loop of a corresponding rectangle within the two-dimensional surface. A three-dimensional stitch has six key points defined as the parameterization of the two-dimensional points $p_1$, $p_2$, $p_3$, $p_4$, $p_5$, and $p_6$. That is, the six key points are defined as the points $s(p_1)$, $s(p_2)$, $s(p_3)$, $s(p_4)$, $s(p_5)$, and $s(p_6)$. The points $p_1$, $p_2$, $p_3$, $p_4$, $p_5$, and $p_6$can also be specified by $\{\hat{k}_i=(u_i,v_i)|0\leqq i\leqq 5\}$. The six corresponding key points in the three-dimensional parametric surface can likewise be specified by $\{s(u_i,v_i)|0\leqq i\leqq 5\}$.

With respect to the two-dimensional object surface, where a stitch loop resides in the tile defined by its four corner points $\hat{n}_0$,$\hat{n}_1$, $\hat{n}_2$, $\hat{n}_3$, then the key points $\{\hat{k}_i=(u_i,v_i)|0\leqq i\leqq 5\}$ are defined as follows:

$$\hat{k}_0=0.35(\hat{n}_3-\hat{n}_0)+\hat{n}_3 \quad (1)$$

$$\hat{k}_1=0.375(\hat{n}_2-\hat{n}_3)+\hat{n}_3 \quad (2)$$

$$\hat{k}_2=0.125(\hat{n}_1-\hat{n}_0)+\hat{n}_0 \quad (3)$$

$$\hat{k}_3=0.35(\hat{n}_4-\hat{n}_0+0.5(\hat{n}_0+\hat{n}_1 \quad (4)$$

$$\hat{k}_4=0.875(\hat{n}_1-\hat{n}_0)+\hat{n}_0 \quad (5)$$

$$\hat{k}_5=0,625(\hat{n}_2-\hat{n}_3)+\hat{n}_3 \quad (6)$$

where $\hat{n}_4$ is the northern neighbor of $\hat{n}_0$. The key points $\{\hat{k}_1=(u_i,v_i)|0\leqq i\leqq 5\}$are selected so that they can be connected into a loop. This loop is mapped into three dimensions by the parameterization function s(●).

The key points are connected using curve segments to obtain the desired stitch loop. The key points $\{s(u_i,v_i)|0\leqq i\leqq 5\}$ are by definition on the surface s(u, v). A loop in physical, real-world knitwear, however, may have slight deviations from the underlying surface s(u, v) due to the physical thickness of the yarn. In different parts of the loop, the deviations may be different. These deviations can be modeled by giving each point $s(u_i, v_i)$ an offset $\lambda_i n(u_i,v_i)$, where $n(u_i,v_i)$ is the surface normal at $s(u_i, v_i)$. The sign and magnitude of each of $\{\lambda_i|0\leqq i\leqq 5\}$ are selected so that the resulting loop is knitted into a knitwear skeleton according to the stitch pattern, and so that there is no intersection with neighboring loops. After the key points are offset, they are connected using cubic cardinal splines to interpolate the points $s(u_0, v_0)$ through $s(u_5, v_5)$.

Figure 10:
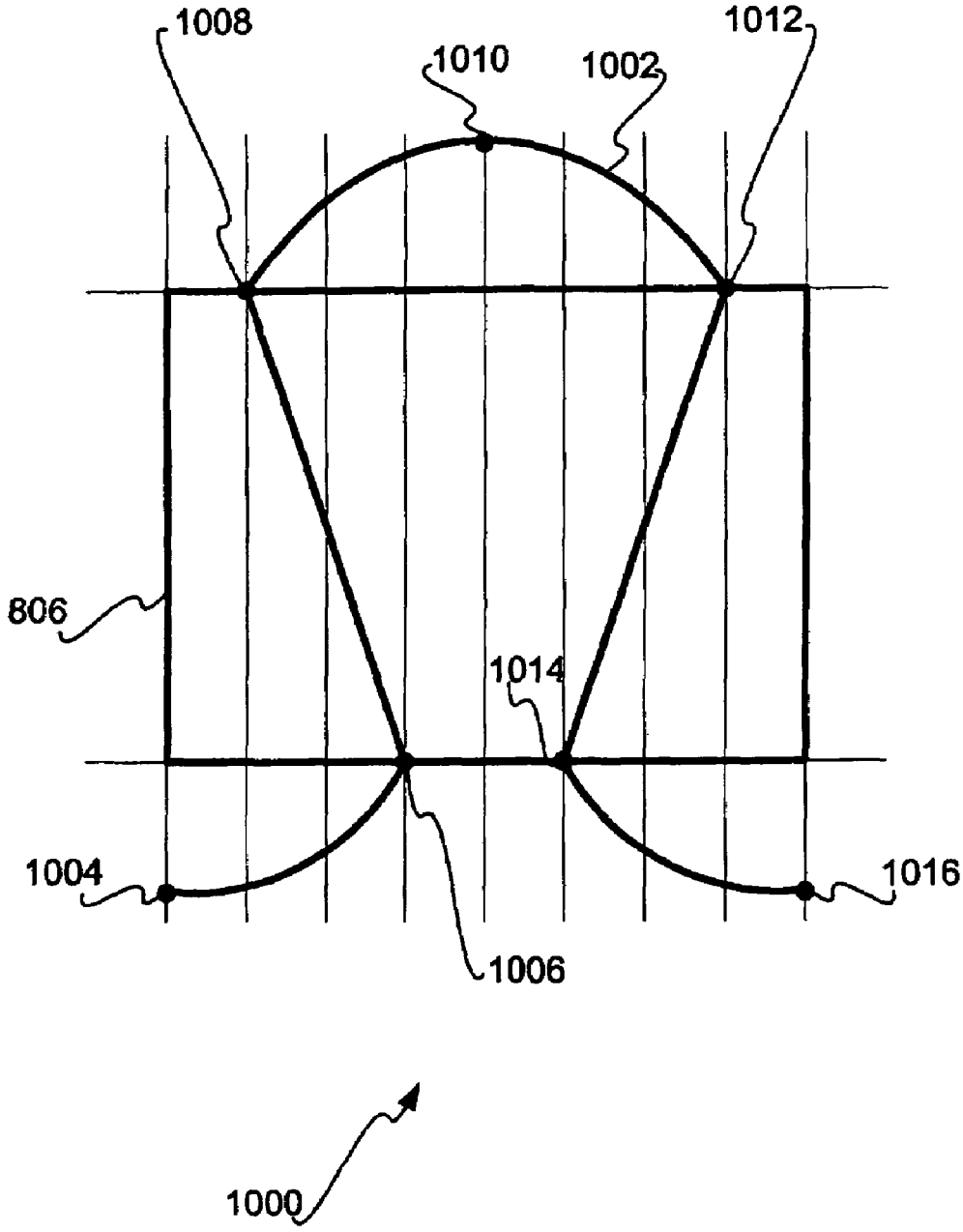
FIG. 10 is a diagram of an example of a stitch loop overlaid on a tile of the two-dimensional object surface of FIG. 8.

The connection of the key points with curved segments to yield a three-dimensional stitch loop is most easily illustrated by showing the corresponding two-dimensional stitch loop in a rectangle of a two-dimensional object surface. In the diagram 1000 of FIG. 10, for instance, the tile 806 has a corresponding stitch 1002. The stitch 1002 is defined by curved segments connecting the six key points of the stitch 1002. The six key points of the stitch 1002 are the points 1006, 1008, 1010, 1012, 1014, and 1016, corresponding to the points $p_1$, $p_2$, $p_3$, $p_4$, $p_5$, and $p_6$, respectively. The point 1004 is a key point of the stitch immediately to the left of the stitch 1002, which is not specifically called out in FIG. 10. Connecting the point 1006 with the point 1004 connects the stitch 1002 with another stitch.

Referring back to FIG. 7, performing 708 for each curved rectangle of the three-dimensional surface results in the knitwear skeleton, or the macrostructure. The key points of all the curved rectangles determine the overall shape of the knitwear model. Because of the relations among all the key points, the knitwear preserves its topological connections during stretching and deformation. As the underlying surface s(u, v) changes shape, each stitch loop also changes shape depending on its location in the knitwear. At the same time, each loop remains correctly interlocked with neighboring loops.

The method also can perform 710 for each curved rectangle of the three-dimensional surface. In 710, color is applied to a curved rectangle. The particular color applied is the color associated with the color number of the color pattern associated with the rectangle of the stitch pattern to which the curved rectangle corresponds. For example, the color pattern can be the color pattern 112 of FIG. 1.

Application of a color from a color pattern in 710 is optional. Alternatively, the knitwear skeleton that results from performing the method 700 of FIG. 7 can-be monochromatic.

Alternative Embodiment: Stitch Position Irregularities

In the embodiment of the invention described in the previous section, the two-dimensional surface 802 of FIG. 8 was partitioned into rectangles, and its corresponding parameterized three-dimensional surface 902 of FIG. 9 was partitioned into curved rectangles. This corresponds to the situation where there are no irregularities in the stitch positions of these rectangles and curved rectangles. In physical, real-world knitwear, however, there are frequently irregularities in the stitch positions. The position of each stitch usually has some randomness, which is present even when the knitwear lies on a flat surface and is not subject to external forces. The irregularities result in the rectangles of the two-dimensional surface and the curved rectangles of the three-dimensional surface becoming more general quadrilaterals and curved quadrilaterals, respectively.

Figure 11:
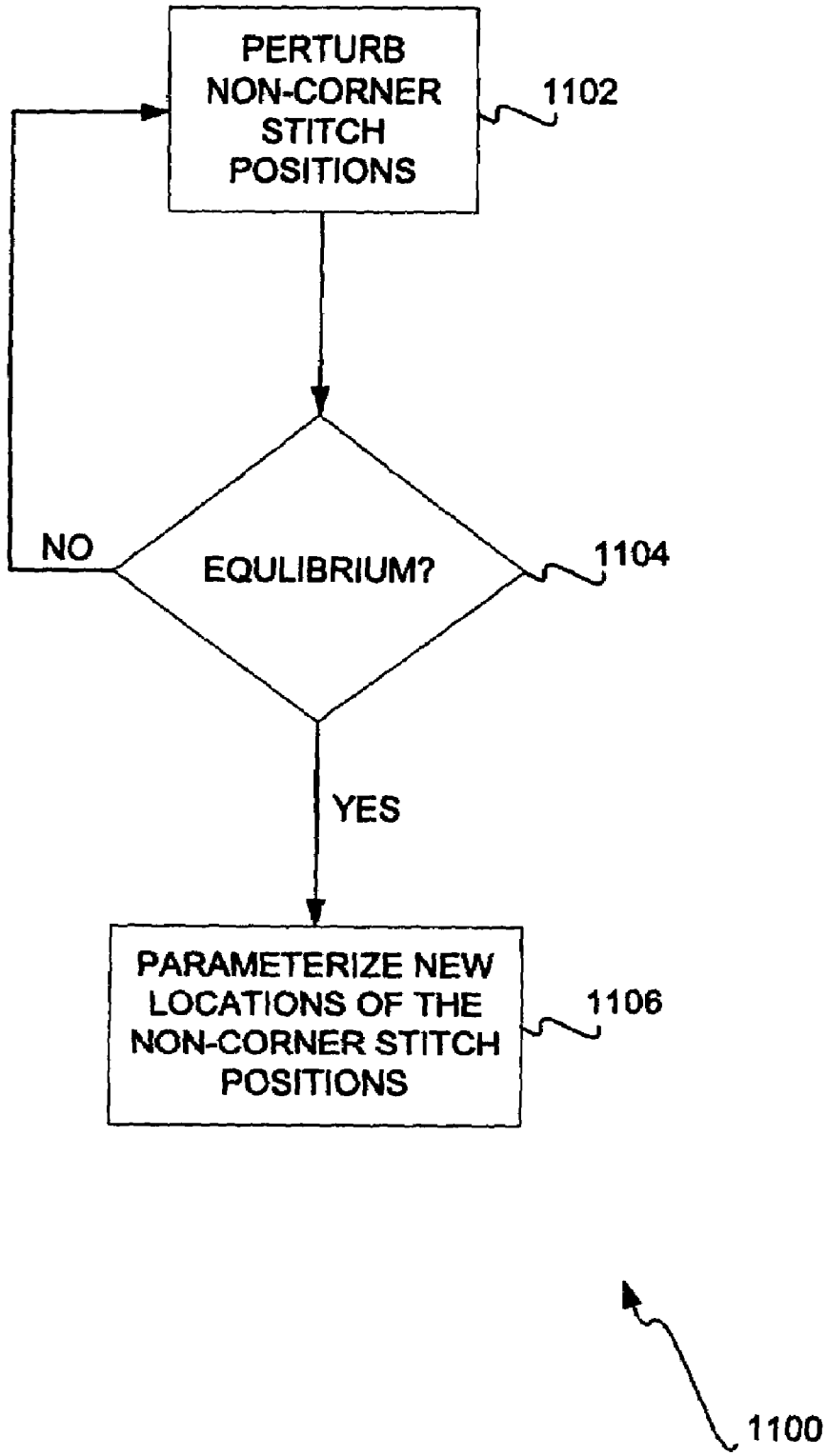
FIG. 11 is a flowchart of a method to recursively perturb non-corner stitch positions, according to an embodiment of the invention.

An alternative embodiment of the invention allows for stitch position irregularities by using a recursive perturbation process to model randomness in the stitch positions. The flowchart of FIG. 11 illustrates a method 1100 to accomplish this process. In 1102, the method perturbs the position of each of the non-corner stitches of a two-dimensional object surface. The two-dimensional object surface can be, for example, the surface 802 of FIG. 8. For a stitch having a position defined as (u, v) over the x-axis and the y-axis, respectively, the stitch is perturbed to a new position. The new position is defined as $(u',v')=(u+\nabla u,v+\nabla v)$, where $\nabla u=\kappa n_u$ and $\nabla v=\kappa n_v$. $n_u$ and $n_v$ are the number of stitches in the u- and v-directions, respectively, and $\kappa$ is a constant determined by the elastic property of the parameter space. If elastic equilibrium has not been reached, the method proceeds from 1104 back to 1102, to recursively repeat the perturbation. Once equilibrium has been reached, the method proceeds to 1206, where it parameterizes the new positions of the non-corner stitches so that the stitch positions are also perturbed in the three-dimensional surface.

Figure 12:
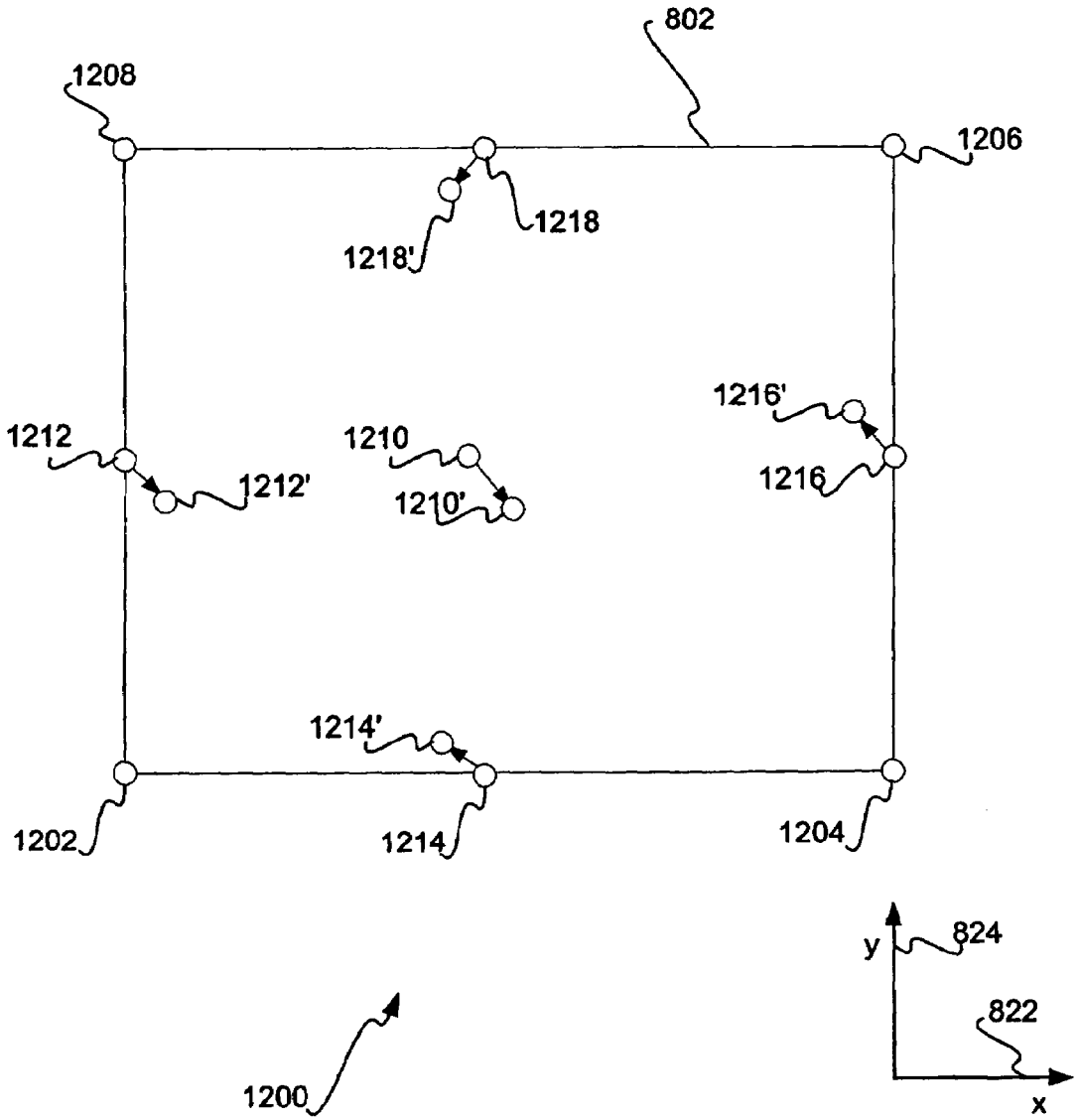
FIG. 12 is a diagram showing perturbation of the non-corner stitch positions of the two-dimensional object surface of FIG. 8.

An example of a two-dimensional object surface having perturbed stitch positions is shown in the diagram 1200 of FIG. 12. The two-dimensional object surface 802 corresponds to a surface patch in the (u, v) domain defined over the x-axis 822 and the y-axis 824. The surface 802 is the same surface 802 shown in FIG. 8, but is shown in FIG. 12 on a more macro, zoomed-out level. The surface 802 has four corner stitches located at positions 1202, 1204, 1206, and 1208. The surface 802 also has five non-corner stitches, which in an unperturbed state are located at positions 1210, 1212, 1214, 1216, and 1218. After perturbation, the non-corner stitches are located at positions 1210', 1212', 1214', 1216', and 1218', achieving a more irregular stitch pattern.

Generating the Yam Microstructure to Be Applied to the Knitwear Skeleton

Figure 13:
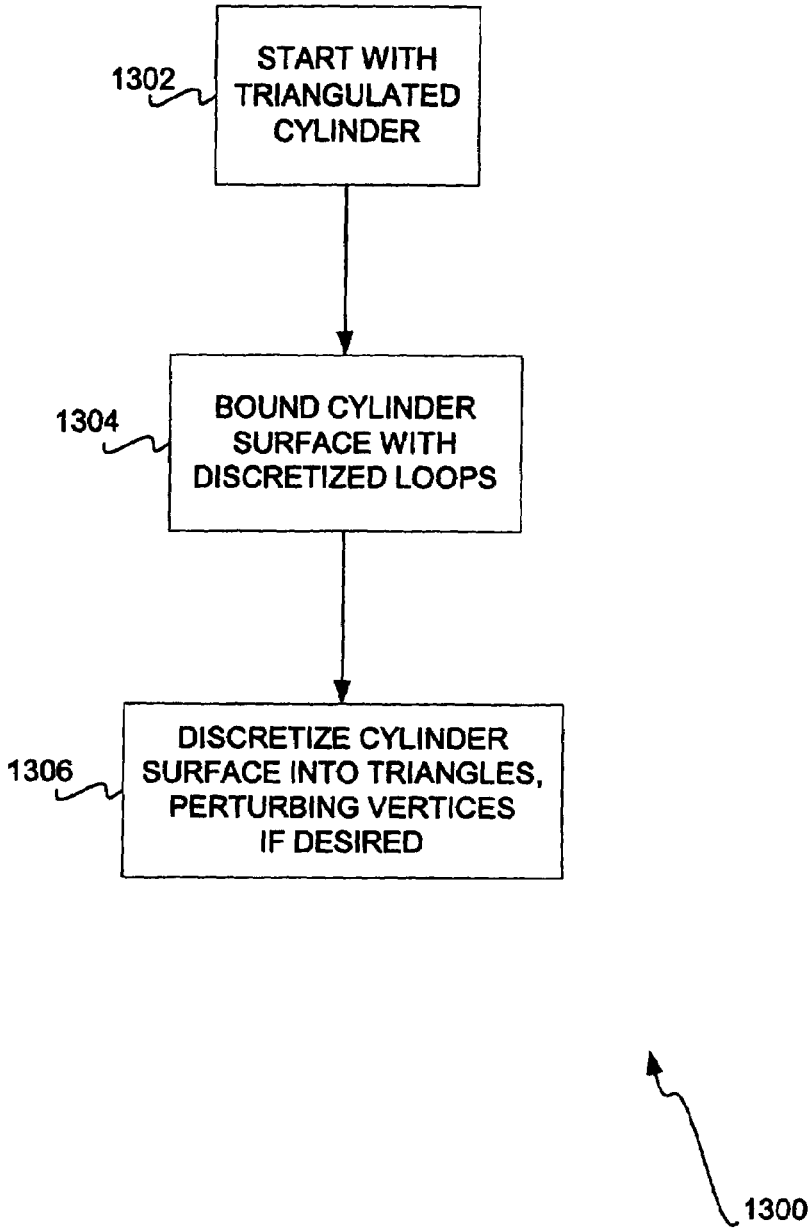
FIG. 13 is a flowchart of a method to generate a yarn microstructure, according to an embodiment of the invention.
Figure 14:
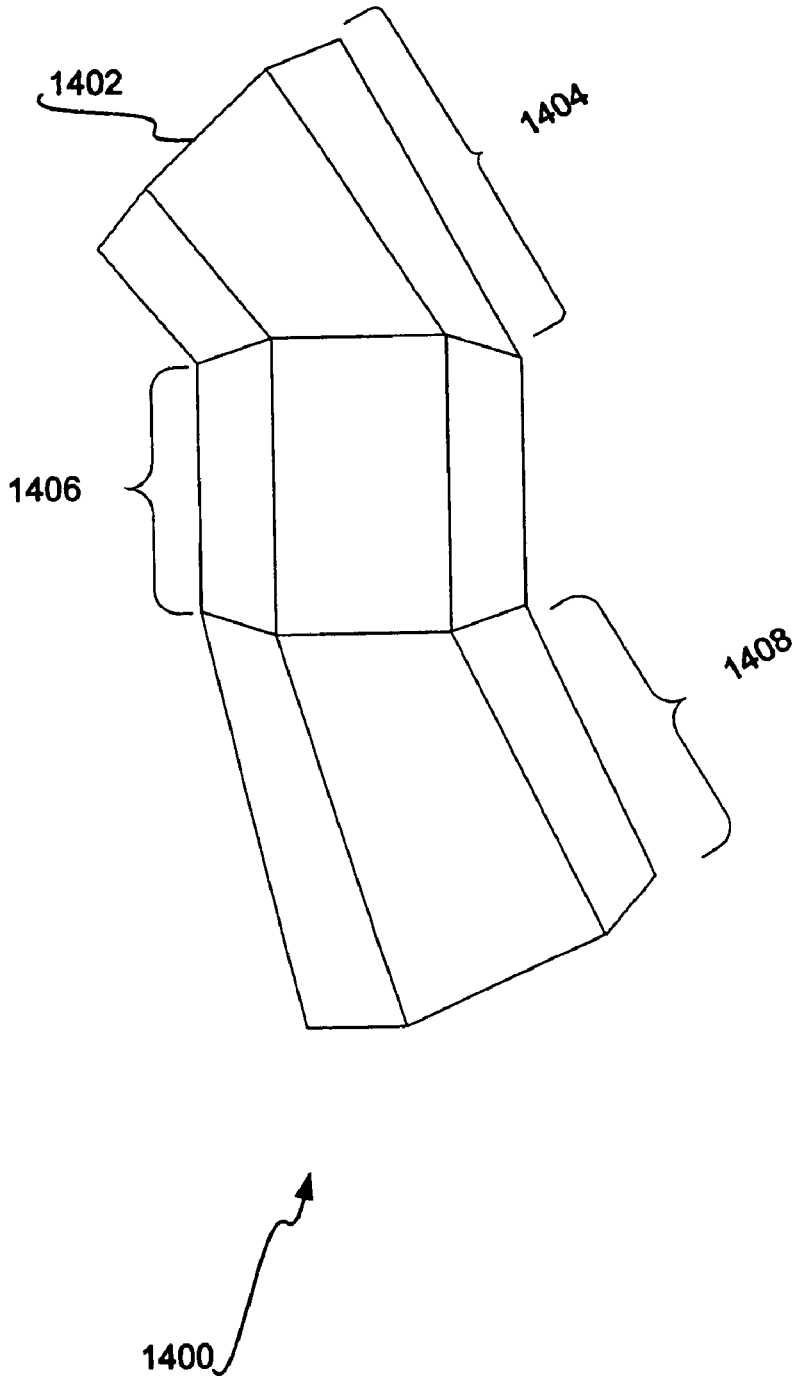
FIG. 14 is a diagram of an example triangulated cylinder forming a yarn microstructure.

The yarn microstructure is the yarn model that is applied to the macrostructure to yield a knitwear model. The microstructure models yarn strands as triangulated cylinders. For each segment of the yarn, the model uses Gouraud-shaded triangles to represent bundles of fiber strands. FIG. 13 is a flowchart of a method 1300 that one embodiment of the invention performs to generate yarn microstructure. The method 1300 can be utilized to generate the microstructure 120 of FIG. 1, for instance. The method starts with a triangulated cylinder in 1302 to approximate a yarn strand. An example of a triangulated cylinder is shown in the diagram 1400 of FIG. 14. The cylinder 1402 represents the shape of the yarn segment, and has three cylinder segments 1404, 1406, and 1408.

Referring back to FIG. 13, in 1304, the method bounds the surface of the cylinder with discretized loops. Specifically, each cylinder segment is bound by two loops. The first loop bounds the top of the segment, while the second loop bounds the bottom of the segment. The first loop is discretized as edges $\{[x_i x_{i+1}] | i=1, \ldots, m \ \& \ x_1=x_m\}$. The second loop is discretized as edges $\{[y_i y_{i+1}] | i=1, \ldots, n \ \& \ y_1=y_n\}$.

Figure 15:
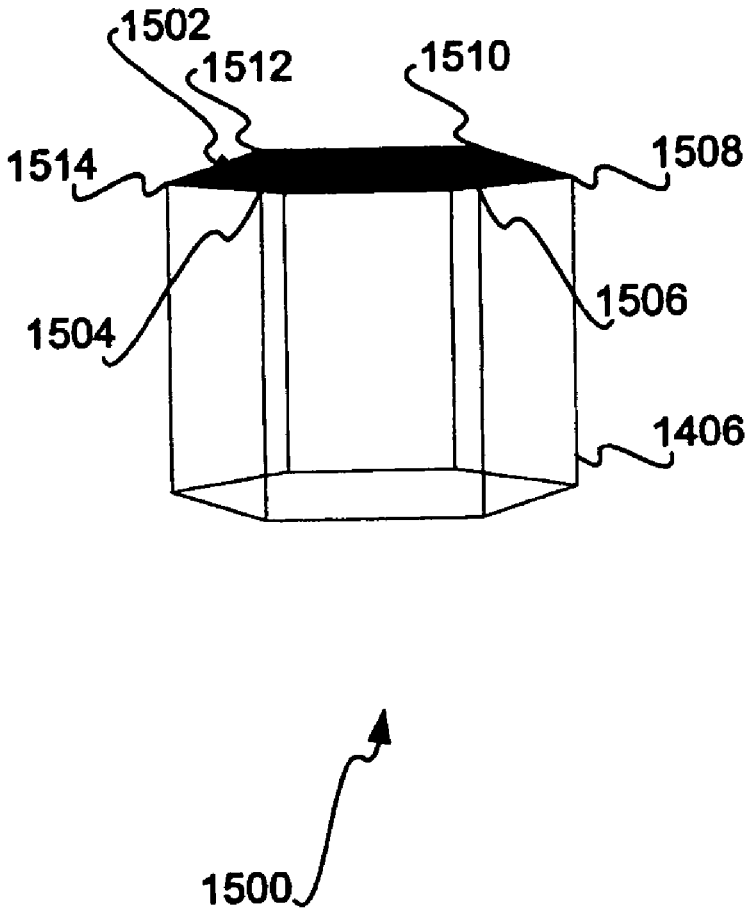
FIG. 15 is a diagram of one of the cylinder segments of the cylinder of FIG. 14 bound by a discretized loop.

An example of a loop-bound cylinder segment is shown in the diagram 1500 of FIG. 15. The diagram 1500 shows the cylinder segment 1406 of FIG. 14 without its accompanying cylinder segments 1404 and 1408, for illustrative clarity. The loop 1502 bounds the top of the segment 1406. The loop bounding the bottom of the segment 1406 is not called out in FIG. 15. The loop 1502 is discretized as edges defined between the points 1504 and 1506, 1506 and 1508, 1508 and 1510, 1510 and 1512, 1512 and 1514, and 1514 and 1504. These edges correspond to $\{[x_i x_{i+1}] | i=1, \ldots, m \ \& \ x_1=x_m\}$, where m=7, and $x_1$, $x_2$, $x_3$, $x_4$, $x_5$, $x_6$, and $x_7$ correspond to the points 1504, 1506, 1508, 1510, 1512, 1514, and 1504, respectively. Note that $x_1=x_7$ and both $x_1$ and $x_7$ each correspond to the point 1504.

Referring back to FIG. 13, in 1306, the method discretizes the cylinder surface into triangles. Specifically, the surface of each cylinder segment is discretized into m+n triangles. The triangles are built by traversing the two loops and generating triangles. For each edge $[x_i x_{i+1}]$ of the first loop, a triangle is formed by randomly choosing a vertex $y_k$ from $\{y_i | i=1, \ldots, n\}$. Likewise, for each edge $[y_i y_{i+1}]$ of the second loop, a triangle is formed by randomly choosing a vertex from $\{x_i | i=1, \ldots, m\}$. The randomized triangle bundle generates a random reflectance comparable to that of knitted fabric.

Figure 16:
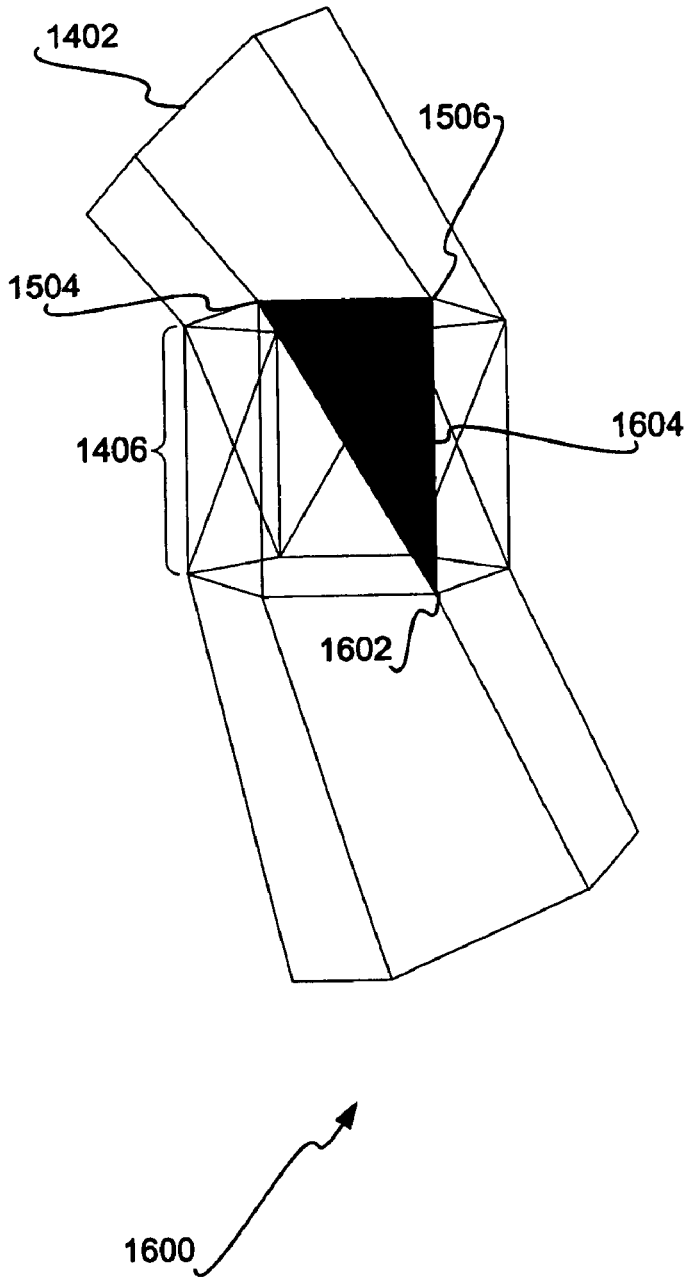
FIG. 16 is a diagram of the cylinder of FIG. 14 in which the surface of one of the cylinder segments is discretized into triangles.

An example of a surface of a cylinder segment that has been discretized into triangles is shown in the diagram 1600 of FIG. 16. The diagram 1600 specifically shows the surface of the cylinder segment 1406 of the cylinder 1402 discretized into triangles. The shaded triangle 1604 is particularly called out in FIG. 16. The triangle 1604 has vertices corresponding to the points 1504, 1506, and 1602. The points 1504 and 1506 are within the top loop bounding the segment 1406, while the point 1602 is within the bottom loop. The points 1504 and 1506 define an edge corresponding to an edge $[x_i x_{i+1}]$ of the first loop, forming a triangle by random selection of a vertex $y_k$ from $\{y_i | i=1, \ldots, n\}$, which corresponds to the point 1602.

Referring back to FIG. 13, the method can optionally in 1306 perturb one or more triangle vertices of each cylinder segment to model variations in yarn fluffiness. When a triangle is added to the triangle bundle, one of the vertices is selected from $\{y_i | i=1, \ldots, n\}$ or $\{x_i | i=1, \ldots, m\}$. To increase fluffiness of the yarn, the method perturbs this vertex outward in the direction of the normal of the cylinder segment surface. The amount of perturbation is a controllable fluffiness parameter, and is proportional to the fluffiness of the resulting modeled yarn microstructure.

Figure 17:
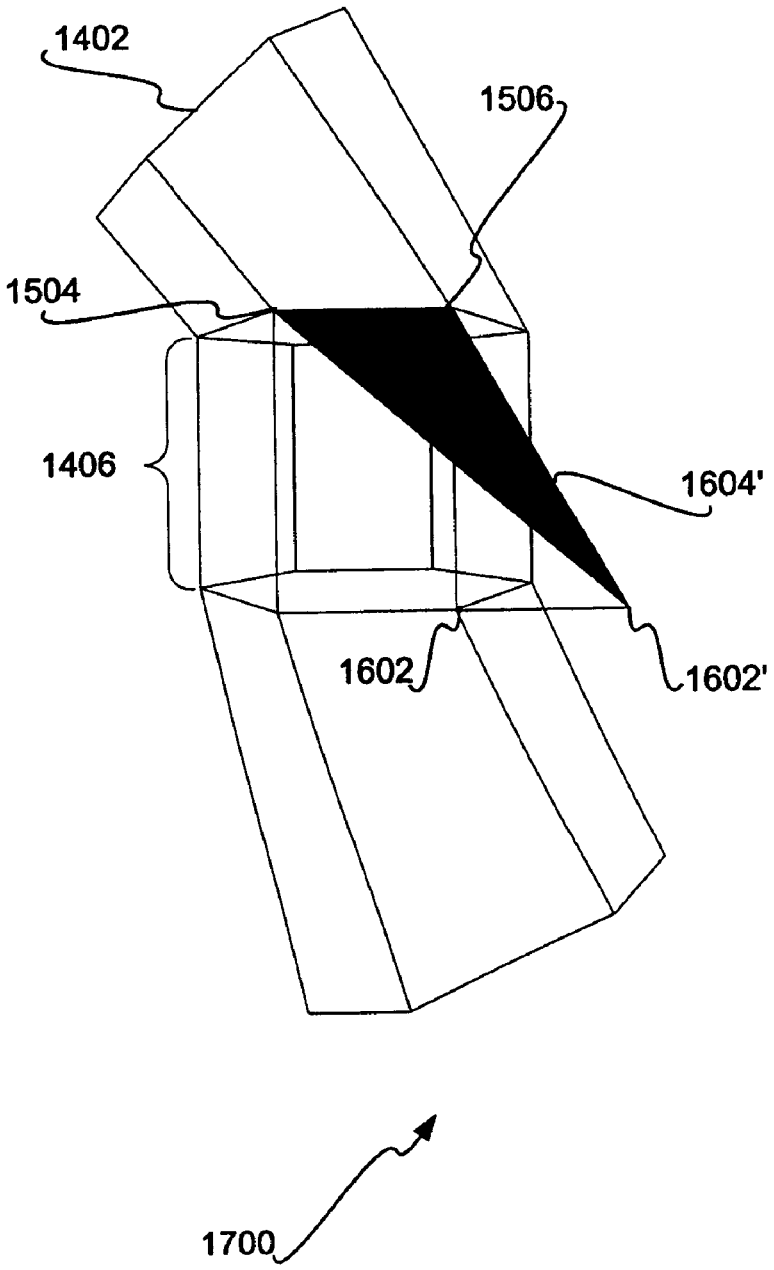
FIG. 17 is a diagram of the cylinder of FIG. 16 in which a vertex of one of the triangles has been perturbed to increase yarn fluffiness.

An example of vertex perturbation to increase yarn fluffiness is shown in the diagram of 1700 of FIG. 17. The cylinder segment 1406 of the cylinder 1402 includes the triangle 1604'. The triangle 1604' corresponds to the triangle 1604 of FIG. 16, but where the bottom vertex of the triangle has been perturbed. While the triangle 1604 of FIG. 16 has vertices 1504, 1506, and 1602, the triangle 1604' of FIG. 17 has vertices 1504, 1506, and 1602'. The vertex 1602' corresponds to the vertex 1602 subject to perturbation. Compared to the triangle 1604 of FIG. 16, the triangle 1604' of FIG. 17 protrudes from the surface of the cylinder segment 1406. The extent of this protrusion corresponds to the fluffiness of the segment 1406.

Applying the Microstructure to the Macrostructure to Render the Knitwear Model

FIG. 18 is a flowchart of a method 1800 that one embodiment of the invention performs to apply the yarn microstructure to the knitwear skeleton, or macrostructure, to render the knitwear model. In 1802, the current stitch is set to the first stitch of the macrostructure. In 1804, the current segment is set to the first curved segment of the current stitch. The method in 1806 models the current segment of the current stitch as a yarn microstructure. That is, the yarn microstructure that has been generated is applied to the current stitch segment. If there are more curved segments in the current stitch, then the method proceeds from 1808 to 1810, where it advances the current segment to the next segment of the current stitch, and repeats 1806. Otherwise, the method proceeds from 1808 to 1811. If there are more stitches in the macrostructure, then the method proceeds from 1811 to 1812, where it advances the current stitch to the next stitch of the macrostructure, and repeats 1804. Otherwise, the method ends in 1814.

Alternative Embodiment: Generating a Two-Dimensional Texture

In the preferred embodiment of the invention, a macrostructure is generated according to a stitch pattern and optionally a color pattern, and a yarn microstructure is applied to the macrostructure to generate a three-dimensional knitwear model. In an alternative embodiment, the invention instead generates a two-dimensional knitwear texture. The approach to generate a two-dimensional knitwear texture is substantially similar to the approach to generate a three-dimensional knitwear model that has been described. In particular, the methods that have been described to generate a three-dimensional knitwear model can be slightly modified to generate a two-dimensional texture instead.

A texture is also known as a texture map. In computer graphics modeling, texture mapping is the application of a type of surface, the texture, to a three-dimensional object. A texture can be uniform, such as a brick wall, or irregular, such as wood grain or marble. In the case of the alternative embodiment of the invention, the texture is a knitwear texture. Texture mapping is a known process that wraps a two-dimensional texture around a three-dimensional object to render a three-dimensional model. For example, a knitwear texture can be applied to a three-dimensional object, such as a human model wearing knitwear clothing, to render a three-dimensional knitwear model.

The method 700 of FIG. 7 has been described as creating a three-dimensional knitwear skeleton. The method 700 of FIG. 7 can be slightly modified to instead create a two-dimensional pre-knitwear texture. A pre-knitwear texture is the two-dimensional analog to a three-dimensional knitwear skeleton. Like the knitwear skeleton, the pre-knitwear texture is generated in accordance with a stitch pattern and optionally a color pattern. Whereas applying a yarn microstructure to a knitwear skeleton yields a knitwear model, applying a yarn microstructure to a pre-knitwear texture yields a knitwear texture.

To generate a two-dimensional pre-knitwear texture in lieu of a three-dimensional knitwear skeleton, the method 700 performs 702 as has been described. 704, however, is skipped. The two-dimensional object surface that the method starts with in 702 is not parameterized to a three-dimensional object surface in 704, but itself forms the basis for the pre-knitwear texture. The method performs 706 for each rectangle of the two-dimensional surface when generating a pre-knitwear texture, instead of performing 706 for each curved rectangle of a three-dimensional surface. Similarly, 708 and optionally 710 are performed relative to a rectangle of the two-dimensional surface. In 708, the key points of the rectangle are connected with curved segments to yield a loop. If 710 is performed, then color is applied from the color pattern. The result of the modified method 700 of FIG. 7 is a pre-knitwear texture.

The method 1800 of FIG. 18 has been described as rendering a three-dimensional knitwear model by applying a microstructure to the macrostructure. The method 1800 can be slightly modified to instead render a two-dimensional knitwear texture by applying a microstructure to the pre-knitwear texture. By substituting the pre-knitwear texture for the macrostructure in the method 1800, the method yields a two-dimensional knitwear texture instead of a three-dimensional knitwear model. For example, in 1802, the current stitch is set to the first stitch of the pre-knitwear texture, instead of to the first stitch of the knitwear skeleton. Similarly, 1811 and 1812 are performed relative to stitches in the pre-knitwear texture, instead of relative to stitches in the knitwear skeleton.

Figure 19:
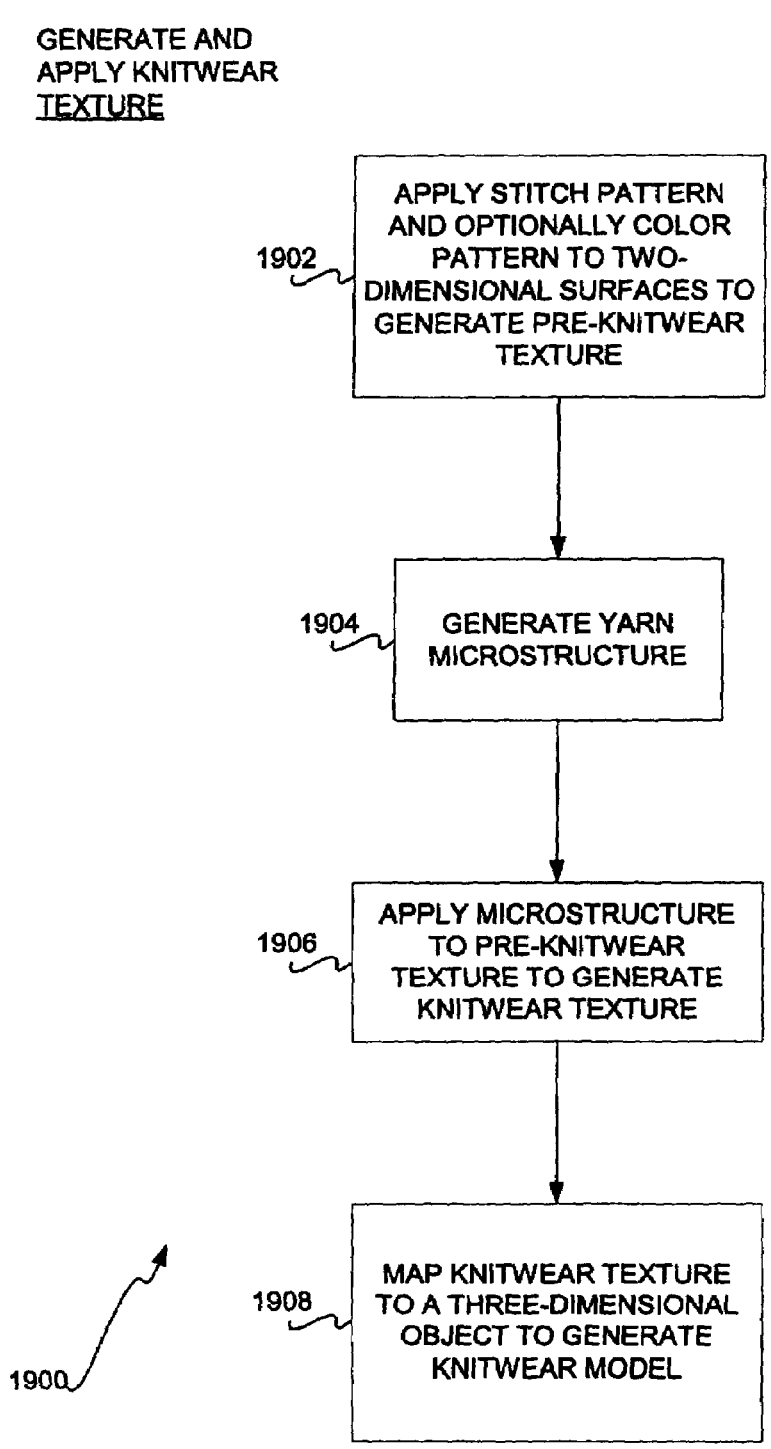
FIG. 19 is a flowchart of a method to generate and apply a knitwear texture, according to an embodiment of the invention.

FIG. 19 is a flowchart illustrating a method 1900 that shows the process for generating and using a knitwear texture. The method 1900 is the two dimensional texture analog to the method 600 of FIG. 6, which summarizes the process for generating a three-dimensional knitwear model. In 1902, the method applies a stitch pattern, and optionally a color pattern, to a two-dimensional object surface to generate a pre-knitwear texture. In 1904, yarn microstructure is generated, which is applied to the pre-knitwear structure in 1906 to yield the knitwear texture. The knitwear texture can then be mapped in 1908 to a three-dimensional object to generate a knitwear model in an alternative manner.

Generating a knitwear texture and applying it to a three-dimensional object is not the preferred approach for generating a knitwear model. This is because the resulting knitwear model is typically of lesser visual quality than a knitwear model rendered according to the preferred embodiment of the invention is. However, the knitwear texture approach may be advantageous in situations where a texture mapping process is already known or is already being utilized. Using the alternative embodiment to generate a knitwear texture in these situations may allow for leveraging existing technology, and may provide for faster integration of the invention with such technology.

Example Computerized Device

Figure 20:
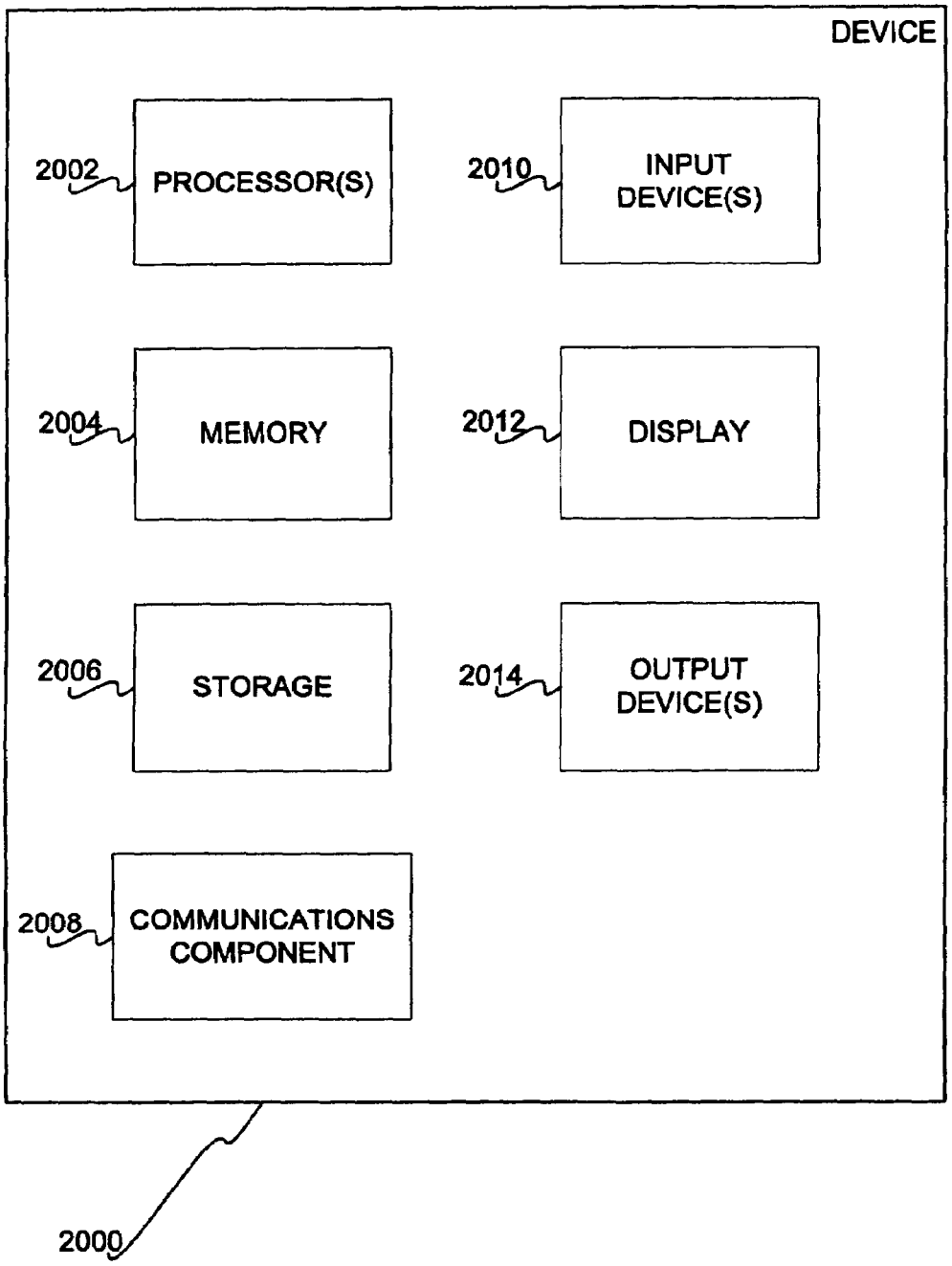
FIG. 20 is a diagram of an example computerized device in conjunction with which the invention may be implemented.

The invention can be implemented within a computerized environment having one or more computerized devices. The diagram of FIG. 20 shows an example computerized device 2000. The device 2000 can be the device that executes the methods that have been described. The example computerized device 2000 can be, for example, a desktop computer, a laptop computer, or a personal digital assistant (PDA). The invention may be practiced with other computer system configurations as well, including multiprocessor systems, microprocessor-based or programmable consumer electronics, network computers, minicomputers, and mainframe computers. The invention may be practiced in distributed computing environments where tasks are performed by remote processing devices that are linked through a communications network.

The device 2000 includes one or more of the following components: processor(s) 2002, memory 2004, storage 2006, a communications component 2008, input device(s) 2010, a display 2012, and output device(s) 2014. For a particular instantiation of the device 2000, one or more of these components may not be present. For example, a PDA may not have any output device(s) 2014. The description of the device 2000 is to be used as an overview of the types of components that typically reside within such a device, and is not meant as a limiting or exhaustive description.

The processor(s) 2002 may include a single central-processing unit (CPU), or a plurality of processing units, commonly referred to as a parallel processing environment. The memory 2004 may include read-only memory (ROM) and/or random-access memory (RAM). The storage 2006 may be any type of storage, such as fixed-media storage devices and removable-media storage devices. Examples of the former include hard disk drives, and flash or other non-volatile memory. Examples of the latter include tape drives, optical drives like CD-ROM drives, and floppy disk drives. The storage devices and their associated computer-readable media provide non-volatile storage of computer-readable instructions, data structures, program modules, and other data Any type of computer-readable media that can store data and that is accessible by a computer can be used.

The device 2000 may operate in a network environment. Examples of networks include the Internet, intranets, extranets, local-area networks (LAN's), and wide-area networks (WAN's). The device 2000 may include a communications component 2008, which can be present in or attached to the device 2000. The component 2008 may be one or more of a network card, an Ethernet card, an analog modem, a cable modem, a digital subscriber loop (DSL) modem, and an Integrated Services Digital Network (ISDN) adapter. The input device(s) 2010 are the mechanisms by which a user provides input to the device 2000. Such device(s) 2010 can include keyboards, pointing devices, microphones, joysticks, game pads, and scanners. The display 2012 is how the device 2000 typically shows output to the user. The display 2012 can include cathode-ray tube (CRT) display devices and flat-panel display (FPD) display devices. The device 2000 may provide output to the user via other output device(s) 2014. The output device(s) 2014 can include speakers, printers, and other types of devices.

Knitwear models and textures can be stored as data or as a data structure on a machine-readable medium, such as a memory, a hard disk drive, or a CD-ROM. The methods that have been described can be computer-implemented. A computer-implemented method is desirably realized at least in part as one or more programs running on a computer. The programs can be executed from a computer-readable medium such as a memory by a processor of a computer. The programs are desirably storable on a machine-readable medium, such as a floppy disk or a CD-ROM, for distribution and installation and execution on another computer. The program or programs can be a part of a computer system, a computer, or a computerized device.

CONCLUSION

It is noted that, although specific embodiments have been illustrated and described herein, it will be appreciated by those of ordinary skill in the art that any arrangement that is calculated to achieve the same purpose may be substituted for the specific embodiments shown. This application is intended to cover any adaptations or variations of the present invention. Therefore, it is manifestly intended that this invention be limited only by the claims and equivalents thereof.

We claim:

1. A computer-implemented process for modeling knitwear, said process comprising:

a generating step for generating a macrostructure for a three-dimensional object, based on at least a stitch pattern;

an irregularity introducing step for introducing irregularities in stitch positions of the macrostructure; generating a yarn microstructure; and, an applying step for applying the yarn microstructure to the macrostructure to yield a knitwear model.

2. The process of claim 1, wherein the step for introducing the irregularities in the stitch positions of the macrostructure comprises:

perturbing non-corner stitch positions of the two-dimensional surface until equilibrium is reached; and, parameterizing the non-corner stitch positions of the two-dimensional surface to corresponding non-corner stitch positions of the three-dimensional surface.

3. The process of claim 1, wherein the step for generating the yarn microstructure comprises:

bounding each of a plurality of segments of a triangulated cylinder surface of the yarn microstructure with a first discretized loop and a second discretized loop; and, discretizing each segment of the cylinder surface into triangles, each triangle having vertices located on the first and the second discretized loops.

4. The process of claim 3, wherein the step for generating the yarn microstructure further comprises perturbing one of the vertices of each triangle to increase fluffiness of the yarn microstructure.

5. The process of claim 1, wherein the step for applying the yarn microstructure to the macrostructure to yield the knitwear model comprises:

for each stitch of a plurality of stitches of the macrostructure, for each curved segment of a plurality of curved segments of the stitch, applying the yarn microstructure to the curved segment.

6. The process of claim 1, wherein the step for generating the macrostructure is further based on a color pattern.

7. The process of claim 1, wherein the step for generating the macrostructure comprises applying the stitch pattern to surfaces of the three-dimensional object.

8. The process of claim 1, wherein the step for generating the macrostructure is further based on a color pattern, and comprises a step for applying the stitch and the color patterns to surfaces of the three-dimensional object.

9. The process of claim 1, wherein the step for generating the macrostructure comprises:

parameterizing a two-dimensional surface partitioned into quadrilaterals and corresponding to the stitch pattern to a three-dimensional surface partitioned into curved quadrilaterals, in accordance with the three-dimensional object;

for each curved quadrilateral of the three-dimensional surface, connecting a plurality of key points of the curved quadrilateral with curved segments to yield a stitch loop, the three-dimensional surface resulting in the macrostructure.

10. The process of claim 9, wherein the step for generating the macrostructure is further based on a color pattern, and further comprises, for each curved quadrilateral of the three-dimensional surface, applying a color from the color pattern.

11. The process of claim 9, wherein each quadrilateral of the two-dimensional surface comprises a rectangle, and each curved quadrilateral of the three-dimensional surface comprises a curved rectangle.

12. A computer-implemented process for modeling knitwear, said process comprising:

a parameterizing step for parameterizing a two-dimensional surface partitioned into quadrilaterals and corresponding to a stitch pattern to a three-dimensional surface partitioned into curved quadrilaterals, in accordance with a three-dimensional object;

for each curved quadrilateral of the three-dimensional surface, a connecting step for connecting a plurality of key points of the curved quadrilateral with curved segments to yield a stitch loop, a stitch of the curved quadrilateral comprising the stitch loop, the three-dimensional surface resulting in a macrostructure;

a bounding step for bounding each of a plurality of segments of a triangulated cylinder surface with a first discretized loop and a second discretized loop;

a discretizing step for discretizing each segment of the cylinder surface into triangles, each triangle having vertices located on the first and the second discretized loops, the cylinder surface resulting in a yarn microstructure;

for each curved segment of each stitch of the macrostructure, an applying step for applying the yarn microstructure to the curved segment, the macrostructure resulting in a knitwear model.

13. The process of claim 12, wherein the two-dimensional surface further corresponds to a color pattern.

14. The process of claim 12, further comprising, prior to bounding each of the plurality of segments of the triangulated cylinder surface, a perturbing step for perturbing non-corner stitch positions of the two-dimensional surface until equilibrium is reached; and, a parameterizing step for parameterizing the non-corner stitch positions of the two-dimensional surface to corresponding non-corner stitch positions of the three-dimensional surface, the three-dimensional surface resulting in a surface having irregular stitch positions.

15. The process of claim 12, further comprising, subsequent to discretizing each segment of the cylinder surface into triangles, a perturbing step for perturbing one of the vertices of each triangle to increase fluffiness of the yarn microstructure.

16. A computer-implemented process for generating knitwear, the process comprising:

a texture generating step for generating a pre-knitwear texture, based on at least a stitch pattern;

a yarn generating step for generating a yarn microstructure wherein generating the yarn microstructure comprises:

bounding each of a plurality of segments of a triangulated cylinder surface of the yarn microstructure with a first discretized loop and a second discretized loop; and, discretizing each segment of the cylinder surface into triangles, each triangle having vertices located on the first and the second discretized loops; and, an applying step for applying the yarn microstructure to the pre-knitwear texture to yield a two-dimensional knitwear texture.

17. The process of claim 16, wherein the step for generating the yarn microstructure further comprises perturbing one of the vertices of each triangle to increase fluffiness of the yarn microstructure.

18. The process of claim 16, wherein the step for applying the yarn microstructure to the pre-knitwear texture to yield the two-dimensional knitwear texture comprises:

for each stitch of a plurality of stitches of the pre-knitwear texture, for each curved segment of a plurality of curved segments of the stitch, applying the yarn microstructure to the curved segment.

19. The process of claim 16, further comprising a mapping step for mapping the two-dimensional knitwear texture to a three-dimensional object to yield a knitwear model.

20. The process of claim 16, wherein the step for generating the pre-knitwear texture is further based on a color pattern.

21. The process of claim 16, wherein the step for generating the pre-knitwear texture comprises applying the stitch pattern to a two-dimensional surface.

22. The process of claim 16, wherein the step for generating the pre-knitwear texture is further based on a color pattern, and comprises applying the stitch and the color patterns to the two-dimensional surface.

23. The process of claim 16, wherein the step for generating the pre-knitwear texture comprises, for each of a plurality of quadrilaterals into which a two-dimensional surface is partitioned, connecting a plurality of key points of the quadrilateral with curved segments to yield a stitch loop, the two-dimensional surface resulting in the pre-knitwear texture.

24. The process of claim 23, wherein the step for generating the pre-knitwear texture is further based on a color pattern, and further comprises, for each quadrilateral of the two-dimensional surface, applying a color from the color pattern.

25. The process of claim 23, wherein each quadrilateral of the two-dimensional surface comprises a rectangle.

26. The process of claim 16, further comprising, prior to generating the yarn microstructure, introducing irregularities in stitch positions of the pre-knitwear texture.

27. The process of claim 26, wherein the step for introducing the irregularities in the stitch positions of the pre-knitwear texture comprises perturbing non-corner stitch positions of the two-dimensional surface until equilibrium is reached.

28. A computer-implemented process for modeling knitwear, said process comprising:

for each of a plurality of quadrilaterals into which a two-dimensional surface corresponding to a stitch pattern is partitioned, a pre-knitwear texture generating step for connecting a plurality of key points of the quadrilateral with curved segments to yield a stitch loop, a stitch of the quadrilateral comprising the stitch loop, the two-dimensional surface resulting in a pre-knitwear texture;

a bounding step for bounding each of a plurality of segments of a triangulated cylinder surface with a first discretized loop and a second discretized loop;

a discretizing step for discretizing each segment of the cylinder surface into triangles, each triangle having vertices located on the first and the second discretized loops, the cylinder surface resulting in a yarn microstructure; and, for each curved segment of each stitch of the pre-knitwear texture, an applying step for applying the microstructure to the curved segment, the pre-knitwear texture resulting in a two-dimensional knitwear texture.

29. The process of claim 28, the process further comprising a mapping step for mapping the two-dimensional knitwear texture to a three-dimensional object to yield a knitwear model.

30. The process of claim 28, wherein the two-dimensional surface further corresponds to a color pattern.

31. The process of claim 28, wherein the process further comprises, prior to bounding each of the plurality of segments of the triangulated cylinder surface, a perturbing step for perturbing non-corner stitch positions of the two-dimensional surface until equilibrium is reached, the two-dimensional surface resulting in a surface having irregular stitch positions.

32. The process of claim 28, wherein the process further comprises, subsequent to discretizing each segment of the cylinder surface into triangles, a perturbing step for perturbing one of the vertices of each triangle to increase fluffiness of the yarn microstructure.

* * * * *